US010645518B2

(12) United States Patent
Eronen et al.

(10) Patent No.: US 10,645,518 B2
(45) **Date of Patent: *May 5, 2020**

(54) DISTRIBUTED AUDIO CAPTURE AND MIXING

(71) Applicant: Nokia Technologies Oy, Espoo (FI)

(72) Inventors: Antti Eronen, Tampere (FI); Jussi Leppanen, Tampere (FI); Arto Lehtiniemi, Lempaala (FI); Sujeet Mate, Tampere (FI); Francesco Cricri, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

This patent is subject to a terminal disclaimer.

(21) Appl. No.: 15/767,422

(22) PCT Filed: Oct. 7, 2016

(86) PCT No.: PCT/FI2016/050705

§ 371 (c)(1),
(2) Date: Apr. 11, 2018

(87) PCT Pub. No.: WO2017/064367

PCT Pub. Date: Apr. 20, 2017

(65) Prior Publication Data

US 2018/0295463 A1 Oct. 11, 2018

(30) Foreign Application Priority Data

Oct. 12, 2015 (GB) ..... 1518023.5

(51) Int. Cl.
*H04R 5/02* (2006.01)
*H04S 7/00* (2006.01)
(Continued)

(52) U.S. Cl.
CPC ..... *H04S 7/304* (2013.01); *G10L 19/008* (2013.01); *H04R 1/406* (2013.01); *H04R 3/005* (2013.01);
(Continued)

(58) Field of Classification Search
CPC ..... G10L 19/008; H04R 1/406; H04R 3/005; H04R 2420/07; H04R 2460/07; H04S 5/00; H04S 7/304; H04S 2400/01
(Continued)

(56) References Cited

U.S. PATENT DOCUMENTS

2009/0092259 A1 4/2009 Jot et al.
2011/0301730 A1* 12/2011 Kemp ..... G10L 19/008 700/94
(Continued)

FOREIGN PATENT DOCUMENTS

WO WO 2012/072798 A1 6/2012
WO WO-2014165326 A1 10/2014

OTHER PUBLICATIONS

Braasch, Jonas, et al., "Mixing Console Design Considerations for Telematic Music Applications", Audio Engineering Society Convention Paper, Oct. 9-12, 2009, abstract.
(Continued)

*Primary Examiner* — Ammar T Hamid
(74) *Attorney, Agent, or Firm* — Harrington & Smith

(57) ABSTRACT

A spatial audio signal is received that is associated with a microphone array configured to provide spatial audio capture and additional audio signal(s) associated with an additional microphone, the additional audio signal having been delayed by a variable delay determined such that common components of the spatial audio signal and the additional audio signal(s) are time aligned. A relative position is received between a first position associated with the micro-
(Continued)

phone array and a second position associated with the additional microphone. Source parameter(s) are received classifying an audio source associated with the common components and/or space parameter(s) identifying an environment within which the audio source is located. Processing effect ruleset is determined based on the source parameter(s) and/or the space parameter(s). Multiple output audio channel signals are generated by mixing and applying processing effect(s) to the spatial audio signal and the additional audio signal(s) based on the processing effect ruleset(s).

20 Claims, 12 Drawing Sheets

(51) Int. Cl.

| | |
|---|---|
| ***H04R 3/00*** | (2006.01) |
| ***H04R 1/40*** | (2006.01) |
| ***H04S 5/00*** | (2006.01) |
| ***G10L 19/008*** | (2013.01) |
| *H04R 5/00* | (2006.01) |

(52) U.S. Cl.
CPC ..... *H04S 5/00* (2013.01); *H04R 2420/07* (2013.01); *H04R 2460/07* (2013.01); *H04S 2400/01* (2013.01); *H04S 2400/11* (2013.01); *H04S 2400/15* (2013.01); *H04S 2420/01* (2013.01)

(58) Field of Classification Search
USPC ..... 381/310, 26
See application file for complete search history.

(56) References Cited

U.S. PATENT DOCUMENTS

| | | | | |
|---|---|---|---|---|
| 2016/0266865 | A1* | 9/2016 | Tsingos | H04S 7/304 |
| 2017/0127035 | A1* | 5/2017 | Kon | H04N 5/64 |

OTHER PUBLICATIONS

Braasch, Jonas, et al., "Mixing Console Design Considerations for Telematic Music Applications", Audio Engineering Society Convention Paper, Oct. 9-12, 2009, full text.

* cited by examiner

DISTRIBUTED AUDIO CAPTURE AND MIXING

FIELD

The present application relates to apparatus and methods for distributed audio capture and mixing. The invention further relates to, but is not limited to, apparatus and methods for distributed audio capture and mixing for spatial processing of audio signals to enable spatial reproduction of audio signals.

BACKGROUND

Capture of audio signals from multiple sources and mixing of those audio signals when these sources are moving in the spatial field requires significant manual effort. For example the capture and mixing of an audio signal source such as a speaker or artist within an audio environment such as a theatre or lecture hall to be presented to a listener and produce an effective audio atmosphere requires significant investment in equipment and training.

A commonly implemented system would be for a professional producer to utilize a close microphone, for example a Lavalier microphone worn by the user or a microphone attached to a boom pole to capture audio signals close to the speaker or other sources, and then manually mix this captured audio signal with a suitable spatial (or environmental or audio field) audio signal such that the produced sound comes from an intended direction. As would be expected manually positioning a sound source within the spatial audio field requires significant time and effort to do manually. Furthermore such professionally produced mixes are not particularly flexible and cannot easily be modified by the end user. For example to 'move' the close microphone audio signal within the environment further mixing adjustments are required in order that the source and the audio field signals do not produce a perceived clash.

Thus, there is a need to develop solutions which automate part or all of the spatial audio capture, mixing and sound track creation process.

SUMMARY

According to a first aspect there is provided an apparatus comprising a processor configured to: receive a spatial audio signal associated with a microphone array configured to provide spatial audio capture and at least one additional audio signal associated with an additional microphone, the additional audio signal having been delayed by a variable delay determined such that common components of the spatial audio signal and the at least one additional audio signal are time aligned; receive a relative position between a first position associated with the microphone array and a second position associated with the additional microphone; receive at least one source parameter classifying an audio source associated with the common components and/or at least one space parameter identifying an environment within which the audio source is located; determine at least one processing effect ruleset based on the at least one source parameter and/or the at least one space parameter; generate at least two output audio channel signals by mixing and applying at least one processing effect to the spatial audio signal and the at least one additional audio signal based on the at least one processing effect ruleset.

The processor configured to determine the at least one processing effect ruleset may be configured to determine the at least one processing effect to be applied to the at least one additional audio signal based on the at least one source parameter and/or at least one space parameter.

The processor may be further configured to receive an effect user input, wherein the processor may be further configured to determine the at least one processing effect to be applied to the at least one additional audio signal based on the effect user input.

The processor configured to determine the at least one processing effect ruleset may be further configured to determine a range of available inputs for parameters controlling the at least one processing effect based on the at least one source parameter and/or at least one space parameter.

The processor may be further configured to receive a parameter user input, wherein the processor may be further configured to determine a parameter value from the range of available inputs for parameters controlling the at least one processing effect based on the parameter user input.

The processor configured to generate the at least two output audio channel signals by mixing and applying the at least one processing effect to the spatial audio signal and the at least one additional audio signal may be further configured to mix and apply the at least one processing effect to the spatial audio signal and the at least one additional signal based on the relative position between the first position associated with the microphone array and the second position associated with the additional microphone.

The processor may be further configured to receive a user input defining an orientation of a listener, and the processor configured to generate the at least two output audio channel signals by mixing and applying the at least one processing effect to the spatial audio signal and the at least one additional audio signal may be further configured to generate the at least two output audio channel signals from the mix of the spatial audio signal and the at least one additional audio signal based on the user input.

According to a second aspect there is provided an apparatus comprising a processor configured to: determine a spatial audio signal captured by a microphone array at a first position configured to provide spatial audio capture; determine at least one additional audio signal captured by an additional microphone at a second position; determine and track a relative position between the first position and the second position; determine a variable delay between the spatial audio signal and the at least one additional audio signal such that common components of the spatial audio signal and the at least one additional audio signal are time aligned; apply the variable delay to the at least one additional audio signal to substantially align the common components of the spatial audio signal and at least one additional audio signal; and determine at least one source parameter classifying an audio source associated with the common components and/or at least one space parameter identifying an environment within which the audio source is located based on the at least one additional audio signal.

The processor configured to determine the at least one source parameter and/or the at least one space parameter may be configured to determine the at least one source parameter and/or the at least one space parameter further based on at least one of: the spatial audio signal; and at least one camera image.

The processor configured to determine the at least one space parameter may be configured to determine a room reverberation time associated with the at least one additional audio signal.

The processor configured to determine the at least one space parameter may be configured to determine a room classifier configured to identify a space type within which the audio source is located.

The processor configured to determine the at least one space parameter may be configured to: determine at least one interim space parameter based on the at least one additional audio signal; determine at least one further interim space parameter based on an analysis of at least one camera image; and determine at least one final space parameter based on the at least one interim space parameter and the at least one further interim space parameter.

The processor configured to determine the at least one source parameter may be configured to: determine whether the at least one audio source is a vocal source or an instrument source based on an extracted feature analysis of the at least one additional audio signal; determine an interim vocal classification of the at least one audio source based on the processor determining the at least one audio source is a vocal source and determine an interim instrument classification of the at least one audio source based on the processor determining the at least one audio source is an instrument source.

The processor configured to determine the at least one source parameter may be configured to: receive at least one image from a camera capturing the at least one audio source; determine a visual classification of the at least one audio source based on the at least one image; determine a final vocal classification of the at least one audio source based on the interim vocal classification and the visual classification or determine a final instrument classification based on the interim instrument classification and the visual classification.

The processor may be further configured to output or store: the spatial audio signal; the at least one additional audio signal; the relative position between the first position and the second position; and the at least one source parameter and/or at least one space parameter.

The microphone array may be associated with a first position tag identifying the first position, and the at least one additional microphone may be associated with a second position tag identifying the second position, wherein the processor configured to determine and track the relative position between the first position and the second position may be configured to determine the relative position based on a comparison of the first position tag and the second position tag.

The processor configured to determine the variable delay may be configured to determine a maximum correlation value between the spatial audio signal and the at least one additional audio signal and determine the variable delay as the time value associated with the maximum correlation value.

The processor may be configured to perform a correlation on the spatial audio signal and the at least one additional audio signal over a range of time values centred at a time value based on a the time required for sound to travel over a distance between the first position and the second position.

The processor configured to determine and track the relative position between the first position and the second position may be configured to: determine the first position defining the position of the microphone array; determine the second position defining the position of the at least one additional microphone; determine a relative distance between the first and second position; and determine at least one orientation difference between the first and second position.

An apparatus may comprise a capture apparatus as discussed herein and a render apparatus as discussed herein.

The at least one additional microphone may comprise at least one of: a microphone physically separate from the microphone array; a microphone external to the microphone array; a Lavalier microphone; a microphone coupled to a person configured to capture the audio output of the person; a microphone coupled to an instrument; a hand held microphone; a lapel microphone; and a further microphone array.

According to a third aspect there is provided a method comprising: receiving a spatial audio signal associated with a microphone array configured to provide spatial audio capture and at least one additional audio signal associated with an additional microphone, the additional audio signal having been delayed by a variable delay determined such that common components of the spatial audio signal and the at least one additional audio signal are time aligned; receiving a relative position between a first position associated with the microphone array and a second position associated with the additional microphone; receiving at least one source parameter classifying an audio source associated with the common components and/or at least one space parameter identifying an environment within which the audio source is located; determining at least one processing effect ruleset based on the at least one source parameter and/or the at least one space parameter; generating at least two output audio channel signals by mixing and applying at least one processing effect to the spatial audio signal and the at least one additional audio signal based on the at least one processing effect ruleset.

Determining the at least one processing effect ruleset may comprise determining the at least one processing effect to be applied to the at least one additional audio signal based on the at least one source parameter and/or at least one space parameter.

The method may further comprise receiving an effect user input, wherein determining the at least one processing effect to be applied to the at least one additional audio signal may further be based on the effect user input.

Determining the at least one processing effect ruleset may comprise determining a range of available inputs for parameters controlling the at least one processing effect based on the at least one source parameter and/or at least one space parameter.

The method may further comprise receiving a parameter user input, wherein determining a parameter value from the range of available inputs for parameters controlling the at least one processing effect may be further based on the parameter user input.

Generating an the at least two output audio channel signals by mixing and applying the at least one processing effect to the spatial audio signal and the at least one additional audio signal may further comprise mixing and applying the at least one processing effect based on the relative position between the first position associated with the microphone array and the second position associated with the additional microphone.

The method may further comprise receiving a user input defining an orientation of a listener, and generating the at least two output audio channel signals by mixing and applying the at least one processing effect to the spatial audio signal and the at least one additional audio signal may further comprise generating the at least two output audio channel signals from the mix of the spatial audio signals and the at least one additional audio signal based on the user input.

According to a fourth aspect there is provided a method comprising: determining a spatial audio signal captured by a microphone array at a first position configured to provide spatial audio capture; determining at least one additional audio signal captured by an additional microphone at a second position; determining and tracking a relative position between the first position and the second position; determining a variable delay between the spatial audio signal and the at least one additional audio signal such that common components of the spatial audio signal and the at least one additional audio signal are time aligned; applying the variable delay to the at least one additional audio signal to substantially align the common components of the spatial audio signal and at least one additional audio signal; and determining at least one source parameter classifying an audio source associated with the common components and/or at least one space parameter identifying an environment within which the audio source is located based on the at least one additional audio signal.

Determining the at least one source parameter and/or the at least one space parameter may comprise determining the at least one source parameter and/or the at least one space parameter further based on at least one of: the spatial audio signal; and at least one camera image.

Determining the at least one space parameter may comprise determining a room reverberation time associated with the at least one additional audio signal.

Determining at the least one space parameter may comprise determining a room classifier configured to identify a space type within which the audio source is located.

Determining the at least one space parameter may comprise: determining at least one interim space parameter based on the at least one additional audio signal; determining at least one further interim space parameter based on an analysis of at least one camera image; and determining at least one final space parameter based on the at least one interim space parameter and the at least one further interim space parameter.

Determining the at least one source parameter may comprise: determining whether the at least one audio source is a vocal source or an instrument source based on an extracted feature analysis of the at least one additional audio signal; and determining an interim vocal classification of the at least one audio source based on determining the at least one audio source is a vocal source and determine an interim instrument classification of the at least one audio source based on determining the at least one audio source is an instrument source.

Determining the at least one source parameter may comprise: receiving at least one image from a camera capturing the at least one audio source; determining a visual classification of the at least one audio source based on the at least one image; and determining a final vocal classification of the at least one audio source based on the interim vocal classification and the visual classification or determine a final instrument classification based on the interim instrument classification and the visual classification.

The method may further comprise outputting or storing: the spatial audio signal; the at least one additional audio signal; the relative position between the first position and the second position; and the at least one source parameter and/or at least one space parameter.

The method may further comprise: associating the microphone array with a first position tag identifying the first position; and associating the at least one additional microphone with a second position tag identifying the second position, wherein determining and tracking the relative position between the first position and the second position may comprise comparing the first position tag and the second position tag to determine the relative position.

Determining the variable delay may comprise: determining a maximum correlation value between the spatial audio signal and the at least one additional audio signal; and determining the variable delay as the time value associated with the maximum correlation value.

Determining the maximum correlation value may comprise performing a correlation on the spatial audio signal and at least one additional audio signal over a range of time values centred at a time value based on a the time required for sound to travel over a distance between the first position and the second position.

Determining and tracking the relative position between the first position and the second position may comprise: determining the first position defining the position of the microphone array; determining the second position defining the position of the at least one additional microphone; determining a relative distance between the first and second position; and determining at least one orientation difference between the first and second position.

A method may comprise: a rendering method as described herein and a capture method as described herein.

According to a fifth aspect there is provided an apparatus comprising: means for receiving a spatial audio signal associated with a microphone array configured to provide spatial audio capture and at least one additional audio signal associated with an additional microphone, the additional audio signal having been delayed by a variable delay determined such that common components of the spatial audio signal and the at least one additional audio signal are time aligned; means for receiving a relative position between a first position associated with the microphone array and a second position associated with the additional microphone; means for receiving at least one source parameter classifying an audio source associated with the common components and/or at least one space parameter identifying an environment within which the audio source is located; means for determining at least one processing effect ruleset based on the at least one source parameter and/or the at least one space parameter; means for generating at least two output audio channel signals by mixing and applying at least one processing effect to the spatial audio signal and the at least one additional audio signal based on the at least one processing effect ruleset.

The means for determining the at least one processing effect ruleset may comprise means for determining the at least one processing effect to be applied to the at least one additional audio signal based on the at least one source parameter and/or at least one space parameter.

The apparatus may further comprise means for receiving an effect user input, wherein the means for determining the at least one processing effect to be applied to the at least one additional audio signal may further be based on the effect user input.

The means for determining the at least one processing effect ruleset may comprise means for determining a range of available inputs for parameters controlling the at least one processing effect based on the at least one source parameter and/or at least one space parameter.

The apparatus may further comprise means for receiving a parameter user input, wherein the means for determining a parameter value from the range of available inputs for parameters controlling the at least one processing effect may be further based on the parameter user input.

The means for generating the at least two output audio channel signals by mixing and applying the at least one processing effect to the spatial audio signal and the at least one additional audio signal may further comprise means for mixing and applying the at least one processing effect based on the relative position between the first position associated with the microphone array and the second position associated with the additional microphone.

The apparatus may further comprise means for receiving a user input defining an orientation of a listener, and the means for generating the at least two output audio channel signals by mixing and applying the at least one processing effect to the spatial audio signal and the at least one additional audio signal may further comprise means for generating the at least two output audio channel signals from the mix of the spatial audio signals and the at least one additional audio signal based on the user input.

According to a fourth aspect there is provided an apparatus comprising: means for determining a spatial audio signal captured by a microphone array at a first position configured to provide spatial audio capture; means for determining at least one additional audio signal captured by an additional microphone at a second position; means for determining and tracking a relative position between the first position and the second position; means for determining a variable delay between the spatial audio signal and the at least one additional audio signal such that common components of the spatial audio signal and the at least one additional audio signal are time aligned; means for applying the variable delay to the at least one additional audio signal to substantially align the common components of the spatial audio signal and at least one additional audio signal; and means for determining at least one source parameter classifying an audio source associated with the common components and/or at least one space parameter identifying an environment within which the audio source is located based on the at least one additional audio signal.

The means for determining the at least one source parameter and/or the at least one space parameter may comprise means for determining the at least one source parameter and/or the at least one space parameter further based on at least one of: the spatial audio signal; and at least one camera image.

The means for determining the at least one space parameter may comprise means for determining a room reverberation time associated with the at least one additional audio signal.

The means for determining at the least one space parameter may comprise determining a room classifier configured to identify a space type within which the audio source is located.

The means for determining the at least one space parameter may comprise: means for determining at least one interim space parameter based on the at least one additional audio signal; means for determining at least one further interim space parameter based on an analysis of at least one camera image; and means for determining at least one final space parameter based on the at least one interim space parameter and the at least one further interim space parameter.

The means for determining the at least one source parameter may comprise: means for determining whether the at least one audio source is a vocal source or an instrument source based on an extracted feature analysis of the at least one additional audio signal; and means for determining an interim vocal classification of the at least one audio source based on determining the at least one audio source is a vocal source and determine an interim instrument classification of the at least one audio source based on determining the at least one audio source is an instrument source.

The means for determining the at least one source parameter may comprise: means for receiving at least one image from a camera capturing the at least one audio source; means for determining a visual classification of the at least one audio source based on the at least one image; and means for determining a final vocal classification of the at least one audio source based on the interim vocal classification and the visual classification or determine a final instrument classification based on the interim instrument classification and the visual classification.

The apparatus may further comprise means for outputting or storing: the spatial audio signal; the at least one additional audio signal; the relative position between the first position and the second position; and the at least one source parameter and/or at least one space parameter.

The apparatus may further comprise: means for associating the microphone array with a first position tag identifying the first position; and associating the at least one additional microphone with a second position tag identifying the second position, wherein the means for determining and tracking the relative position between the first position and the second position may comprise means for comparing the first position tag and the second position tag to determine the relative position.

The means for determining the variable delay may comprise: means for determining a maximum correlation value between the spatial audio signal and the at least one additional audio signal; and means for determining the variable delay as the time value associated with the maximum correlation value.

The means for determining the maximum correlation value may comprise means for performing a correlation on the spatial audio signal and at least one additional audio signal over a range of time values centred at a time value based on a the time required for sound to travel over a distance between the first position and the second position.

The means for determining and tracking the relative position between the first position and the second position may comprise: means for determining the first position defining the position of the microphone array; means for determining the second position defining the position of the at least one additional microphone; means for determining a relative distance between the first and second position; and means for determining at least one orientation difference between the first and second position.

A computer program product stored on a medium may cause an apparatus to perform the method as described herein.

An electronic device may comprise apparatus as described herein.

A chipset may comprise apparatus as described herein.

Embodiments of the present application aim to address problems associated with the state of the art.

SUMMARY OF THE FIGURES

For a better understanding of the present application, reference will now be made by way of example to the accompanying drawings in which.

EMBODIMENTS OF THE APPLICATION

Figure 1:
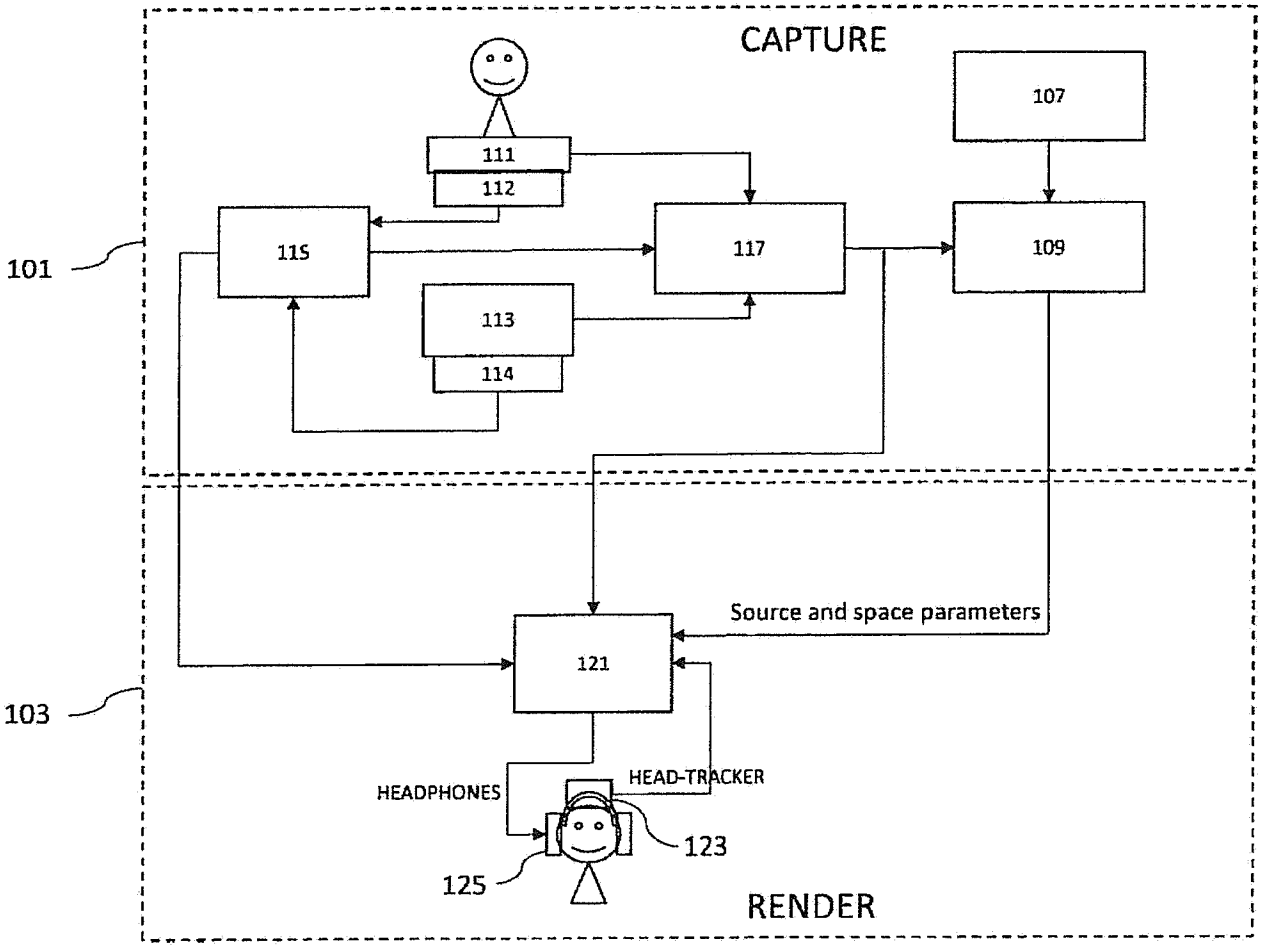
FIG. 1 shows schematically capture and render apparatus suitable for implementing spatial audio capture and rendering according to some embodiments.

The following describes in further detail suitable apparatus and possible mechanisms for the provision of effective capture of audio signals from multiple sources and mixing of those audio signals. In the following examples, audio signals and audio capture signals are described. However it would be appreciated that in some embodiments the apparatus may be part of any suitable electronic device or apparatus configured to capture an audio signal or receive the audio signals and other information signals.

As described previously a conventional approach to the capturing and mixing of audio sources with respect to an audio background or environment audio field signal would be for a professional producer to utilize a close microphone (a Lavalier microphone worn by the user or a microphone attached to a boom pole) to capture audio signals close to the audio source, and further utilize a 'background' microphone to capture an environmental audio signal. These signals or audio tracks may then be manually mixed to produce an output audio signal such that the produced sound features the audio source coming from an intended (though not necessarily the original) direction.

As would be expected this requires significant time and effort and expertise to do correctly. Although automated or semi-automated mixing has been described such mixes are often perceived as being artificial sounding or otherwise do not provide the desired perceptual effect while listening. There is therefore a problem with such mixes as how to make the sources more realistic sounding or otherwise better when listened, for example, by adding suitable effects or processing.

The concept as described herein may be considered to be enhancement to conventional Spatial Audio Capture (SPAC) technology. Spatial audio capture technology can process audio signals captured via a microphone array into a spatial audio format. In other words generating an audio signal format with a spatial perception capacity. The concept may thus be embodied in a form where audio signals may be captured such that, when rendered to a user, the user can experience the sound field as if they were present at the location of the capture device. Spatial audio capture can be implemented for microphone arrays found in mobile devices. In addition, audio processing derived from the spatial audio capture may be used employed within a presence-capturing device such as the Nokia OZO device.

In the examples described herein the audio signal is rendered into a suitable binaural form, where the spatial sensation may be created using rendering such as by head-related-transfer-function (HRTF) filtering a suitable audio signal.

The concept as described with respect to the embodiments herein makes it possible to capture and remix a close and environment audio signal more effectively and efficiently.

The concept may for example be embodied as a capture system configured to capture both a close (speaker, instrument or other source) audio signal and a spatial (audio field) audio signal. The capture system may furthermore be configured to determine or classify a source and/or the space within which the source is located. This information may then be stored or passed to a suitable rendering system which having received the audio signals and the information (source and space classification) may use this information to generate a suitable mixing and rendering of the audio signal to a user. Furthermore in some embodiments the render system may enable the user to input a suitable input to control the mixing, for example by use of a headtracking or other input which causes the mixing to be changed.

The concept furthermore is embodied by the ability to analyse the output of the Lavalier microphones generating the close audio signals for determining parameters required for high quality mixing in a distributed capture and mixing system. This may be embodied by apparatus and methods configured to analyze source describing information, for example, source vocalization type or whether the source is vocal or instrumental, and characteristics of the space such as whether the space is an indoor or outdoor space. This information is then signalled to the renderer or mixer, which applies suitable effects to increase the realism or perceived quality of the automatic mix. For example typical mixes using the Lavalier microphone captured audio signals may sound dull/dry/not fitting to the overall mix. An example effect or processing to improve the realism may include automatically enabling a reverberation effect when the user is singing or not enabling reverberation or using reverberation only slightly when the user is speaking. An aspect of the embodiments as described herein is that an analyser may be configured to determine a certain classification or 'description' of the source(s) and the space/situation, and the renderer can then utilize whatever means it has for applying effects or processing to enhance the signal to fit the capture situation or enhance its aesthetic quality.

It is believed that the main benefits of the embodiments described herein is the selection of suitable effects leading into higher quality automatic mixes.

Although the capture and render systems in the following examples are shown as being separate, it is understood that they may be implemented with the same apparatus or may be distributed over a series of physically separate but communication capable apparatus. For example, a presence-capturing device such as the Nokia OZO device could be equipped with an additional interface for analysing Lavalier microphone sources, and could be configured to perform the capture part. The output of the capture part could be a spatial audio capture format (e.g. as a 5.1 channel downmix), the Lavalier sources which are time-delay compensated to match the time of the spatial audio, and other information such as the classification of the source and the space within which the source is found.

In some embodiments the raw spatial audio captured by the array microphones (instead of spatial audio processed into 5.1) may be transmitted to the renderer, and the renderer perform spatial processing such as described herein.

The renderer as described herein may be a set of headphones with a motion tracker, and software capable of binaural audio rendering. With head tracking, the spatial audio can be rendered in a fixed orientation with regards to the earth, instead of rotating along with the person's head.

Furthermore it is understood that at least some elements of the following capture and render apparatus may be implemented within a distributed computing system such as known as the 'cloud'.

With respect to FIG. 1 is shown a system comprising capture 101 and render 103 apparatus suitable for implementing spatial audio capture and rendering according to some embodiments. In the following examples there is shown only one close audio signal, however more than one close audio signal may be captured and the following apparatus and methods applied to the further close audio signals. For example in some embodiments one or more persons may be equipped with microphones to generate a close audio signal for each person (of which only one is described herein).

For example the capture apparatus 101 comprises a Lavalier microphone 111. The Lavalier microphone is an example of a 'close' audio source capture apparatus and may in some embodiments be a boom microphone or similar neighbouring microphone capture system. Although the following examples are described with respect to a Lavalier microphone and thus a Lavalier audio signal the concept may be extended to any microphone external or separate to the microphones or array of microphones configured to capture the spatial audio signal. Thus the concept is applicable to any external/additional microphones in addition to the SPAC microphone array, be they Lavalier microphones, hand held microphones, mounted mics, or whatever. The external microphones can be worn/carried by persons or mounted as close-up microphones for instruments or a microphone in some relevant location which the designer wishes to capture accurately. The Lavalier microphone 111 may in some embodiments be a microphone array. The Lavalier microphone typically comprises a small microphone worn around the ear or otherwise close to the mouth. For other sound sources, such as musical instruments, the audio signal may be provided either by a Lavalier microphone or by an internal microphone system of the instrument (e.g., pick-up microphones in the case of an electric guitar).

The Lavalier microphone 111 may be configured to output the captured audio signals to a variable delay compensator 117. The Lavalier microphone may be connected to a transmitter unit (not shown), which wirelessly transmits the audio signal to a receiver unit (not shown).

Furthermore the capture apparatus 101 comprises a Lavalier (or close source) microphone position tag 112. The Lavalier microphone position tag 112 may be configured to determine information identifying the position or location of the Lavalier microphone 111 or other close microphone. It is important to note that microphones worn by people can be freely move in the acoustic space and the system supporting location sensing of wearable microphone has to support continuous sensing of user or microphone location. The Lavalier microphone position tag 112 may be configured to output this determination of the position of the Lavalier microphone to a position tracker 115.

The capture apparatus 101 comprises a spatial audio capture (SPAC) device 113. The spatial audio capture device is an example of an 'audio field' capture apparatus and may in some embodiments be a directional or omnidirectional microphone array. The spatial audio capture device 113 may be configured to output the captured audio signals to a variable delay compensator 117.

Furthermore the capture apparatus 101 comprises a spatial capture position tag 114. The spatial capture position tag 114 may be configured to determine information identifying the position or location of the spatial audio capture device 113. The spatial capture position tag 114 may be configured to output this determination of the position of the spatial capture microphone to a position tracker 115.

In some embodiments the spatial audio capture device 113 is implemented within a mobile device. The spatial audio capture device is thus configured to capture spatial audio, which, when rendered to a listener, enables the listener to experience the sound field as if they were present in the location of the spatial audio capture device. The Lavalier microphone in such embodiments is configured to capture high quality close-up audio signals (for example from a key person's voice, or a musical instrument). When mixed to the spatial audio field, the attributes of the key source such as gain and spatial position may be adjusted in order to provide the listener with a much more realistic immersive experience. In addition, it is possible to produce more point-like auditory objects, thus increasing the engagement and intelligibility.

The capture apparatus 101 furthermore may comprise a position tracker 115. The position tracker 115 may be configured to receive the positional tag information identifying positions of the Lavalier microphone 111 and the spatial audio capture device 113 and generate a suitable output identifying the relative position of the Lavalier microphone 111 relative to the spatial audio capture device 113 and output this to the render apparatus 103 and specifically in this example an audio renderer 121. Furthermore in some embodiments the position tracker 115 may be configured to output the tracked position information to a variable delay compensator 117.

Thus in some embodiments the locations of the Lavalier microphones (or the persons carrying them) with respect to the spatial audio capture device can be tracked and used for mixing the sources to correct spatial positions. In some embodiments the position tags, the microphone position tag 112 and the spatial capture position tag 114 are implemented using High Accuracy Indoor Positioning (HAIP) or another suitable indoor positioning technology. In some embodiments, in addition to or instead of HAIP, the position tracker may use video content analysis and/or sound source localization.

In the following example position tracking is implemented using HAIP tags. As shown in FIG. 1, both the Lavalier microphone 111 and the spatial capture device 113 are equipped with HAIP tags (112 and 114 respectively), and then a position tracker 115, which may be a HAIP locator, is configured to track the location of both tags.

In some other implementations, the HAIP locator may be positioned close or attached to the spatial audio capture device and the tracker 115 coordinate system aligned with the spatial audio capture device 113. In such embodiments the position tracker 115 would track just the Lavalier microphone position.

In some embodiments the position tracker comprises an absolute position determiner. The absolute position determiner is configured to receive the HAIP locator tags and generate the absolute positon information from the tag information.

The absolute position determiner may then output this information to the relative position determiner.

The position tracker 115 in some embodiments comprises a relative position determiner configured to receive the absolute positions of the SPAC device and the Lavalier microphones and determine and track the relative position of each. This relative position may then be output to the render apparatus 103.

Thus in some embodiments the position or location of the spatial audio capture device determined. The location of the spatial audio capture device may be denoted (at time 0) as $$(x_S(0),y_S(0))$$

In some embodiments there may be implemented a calibration phase or operation (in other words defining a 0 time instance) where the Lavalier microphone is positioned in front of the SPAC array at some distance within the range of a HAIP locator. This position of the Lavalier microphone may be denoted as $$(x_L(0),y_L(0))$$

Furthermore in some embodiments this calibration phase can determine the 'front-direction' of the spatial audio capture device in the HAIP coordinate system. This can be performed by firstly defining the array front direction by the vector $$(x_L(0)-x_S(0),y_L(0)-y_S(0))$$

This vector may enable the position tracker to determine an azimuth angle $\alpha$ and the distance d with respect to the array.

For example given a Lavalier microphone position at time t $$(x_L(t),y_L(t))$$

The direction relative to the array is defined by the vector $$(x_L(t)-x_S(0),y_L(t)-y_S(0))$$

The azimuth $\alpha$ may then be determined as $$\alpha=a\tan 2(y_L(t)-y_S(0),x_L(t)-x_S(0))-a\tan 2(y_L(0)-y_S(0),x_L(0)-x_S(0))$$

where a tan 2(y,x) is a "Four-Quadrant Inverse Tangent" which gives the angle between the positive x-axis and the point (x,y). Thus, the first term gives the angle between the positive x-axis (origin at $x_S(0)$ and $y_S(0)$) and the point ($x_L(t)$, $y_L(t)$) and the second term is the angle between the x-axis and the initial position ($x_L(0)$, $y_L(0)$). The azimuth angle may be obtained by subtracting the first angle from the second.

The distance d can be obtained as $$\sqrt{(x_L(t)-x_S(0))^2+(y(t)-y_S(0))^2}$$

In some embodiments, since the HAIP location data may be noisy, the positions ($x_L(0)$, $y_L(0)$ and ($x_S(0)$, $y_S(0)$) may be obtained by recording the positions of the HAIP tags of the audio capture device and the Lavalier source over a time window of some seconds (for example 30 seconds) and then averaging the recorded positions to obtain the inputs used in the equations above.

In some embodiments the calibration phase may be initialized by the SPAC device (for example the mobile device) being configured to output a speech or other instruction to instruct the user(s) to stay in front of the array for the 30 second duration, and give a sound indication after the period has ended.

Although the examples shown above show the position tracker 115 generating position information in two dimensions it is understood that this may be generalized to three dimensions, where the position tracker may determine an elevation angle as well as an azimuth angle and distance.

In some embodiments other position tracking means can be used for locating and tracking the moving sources. Examples of other tracking means may include inertial sensors, radar, ultrasound sensing, Lidar or laser distance meters, and so on.

In some embodiments, visual analysis and/or audio source localization are used in addition to or instead of indoor positioning.

Visual analysis, for example, may be performed in order to localize and track pre-defined sound sources, such as persons and musical instruments. The visual analysis may be applied on panoramic video which is captured along with the spatial audio. This analysis may thus identify and track the position of persons carrying the Lavalier microphones based on visual identification of the person. The advantage of visual tracking is that it may be used even when the sound source is silent and therefore when it is difficult to rely on audio based tracking. The visual tracking can be based on executing or running detectors trained on suitable datasets (such as datasets of images containing pedestrians) for each panoramic video frame. In some other embodiments tracking techniques such as kalman filtering and particle filtering can be implemented to obtain the correct trajectory of persons through video frames. The location of the person with respect to the front direction of the panoramic video, coinciding with the front direction of the spatial audio capture device, can then be used as the direction of arrival for that source. In some embodiments, visual markers or detectors based on the appearance of the Lavalier microphones could be used to help or improve the accuracy of the visual tracking methods.

In some embodiments visual analysis can not only provide information about the 2D position of the sound source (i.e., coordinates within the panoramic video frame), but can also provide information about the distance, which is proportional to the size of the detected sound source, assuming that a "standard" size for that sound source class is known. For example, the distance of 'any' person can be estimated based on an average height. Alternatively, a more precise distance estimate can be achieved by assuming that the system knows the size of the specific sound source. For example the system may know or be trained with the height of each person who needs to be tracked.

In some embodiments the 3D or distance information may be achieved by using depth-sensing devices. For example a 'Kinect' system, a time of flight camera, stereo cameras, or camera arrays, can be used to generate images which may be analyzed and from image disparity from multiple images a depth may or 3D visual scene may be created. These images may be generated by the camera 107.

Audio source position determination and tracking can in some embodiments be used to track the sources. The source direction can be estimated, for example, using a time difference of arrival (TDOA) method. The source position determination may in some embodiments be implemented using steered beamformers along with particle filter-based tracking algorithms.

In some embodiments audio self-localization can be used to track the sources.

There are technologies, in radio technologies and connectivity solutions, which can furthermore support high accuracy synchronization between devices which can simplify distance measurement by removing the time offset uncertainty in audio correlation analysis. These techniques have been proposed for future WiFi standardization for the multichannel audio playback systems.

In some embodiments, position estimates from indoor positioning, visual analysis, and audio source localization can be used together, for example, the estimates provided by each may be averaged to obtain improved position determination and tracking accuracy. Furthermore, in order to minimize the computational load of visual analysis (which is typically much "heavier" than the analysis of audio or HAIP signals), visual analysis may be applied only on portions of the entire panoramic frame, which correspond to the spatial locations where the audio and/or HAIP analysis sub-systems have estimated the presence of sound sources.

Position estimation can, in some embodiments, combine information from multiple sources and combination of multiple estimates has the potential for providing the most accurate position information for the proposed systems. However, it is beneficial that the system can be configured to use a subset of position sensing technologies to produce position estimates even at lower resolution.

The capture apparatus 101 furthermore may comprise a variable delay compensator 117 configured to receive the outputs of the Lavalier microphone 111 and the spatial audio capture device 113. Furthermore in some embodiments the variable delay compensator 117 may be configured to receive source position and tracking information from the position tracker 115. The variable delay compensator 117 may be configured to determine any timing mismatch or lack of synchronisation between the close audio source signals and the spatial capture audio signals and determine the timing delay which would be required to restore synchronisation between the signals. In some embodiments the variable delay compensator 117 may be configured to apply the delay to one of the signals before outputting the signals to the render apparatus 103 and specifically in this example to the audio renderer 121. Furthermore the time delayed Lavalier microphone and spatial audio signals may be passed to an analyser 109.

The timing delay may be referred as being a positive time delay or a negative time delay with respect to an audio signal. For example, denote a first (spatial) audio signal by x, and another (Lavalier) audio signal by y. The variable delay compensator 117 is configured to try to find a delay $\pi$, such that $x(n)=y(n-\pi)$. Here, the delay $\pi$ can be either positive or negative.

The variable delay compensator 117 in some embodiments comprises a time delay estimator. The time delay estimator may be configured to receive at least part of the spatial encoded audio signal (for example the central channel of the 5.1 channel format spatial encoded channel). Furthermore the time delay estimator is configured to receive an output from the Lavalier microphone 111. Furthermore in some embodiments the time delay estimator can be configured to receive an input from the position tracker 115.

Since the Lavalier or close microphone may change its location (for example because the person wearing the microphone moves while speaking), the capture apparatus 101 can be configured to track the location or position of the close microphone (relative to the spatial audio capture device) over time. Furthermore, the time-varying location of the close microphone relative to the spatial capture device causes a time-varying delay between the audio signal from the Lavalier microphone and the audio signal generated by the SPAC. The variable delay compensator 117 is configured to apply a delay to one of the signal in order to compensate for the spatial difference, so that the audio signals of the audio source captured by the spatial audio capture device and the Lavalier microphone are equal (assuming the Lavalier source is audible when captured by the spatial audio capture device). If the Lavalier microphone source is not audible or hardly audible in the spatial audio capture device, the delay compensation may be done approximately based on the position (or HAIP location) data.

Thus in some embodiments the time delay estimator can estimate the delay of the close source between the Lavalier microphone and spatial audio capture device.

The time-delay can in some embodiments be implemented by cross correlating the Lavalier microphone signal to the spatial audio capture signal. For example the centre channel of the 5.1 format spatial audio capture audio signal may be correlated against the Lavalier microphone audio signal. Moreover, since the delay is time-varying, the correlation is performed over time. For example short temporal frames, for example of 4096 samples, can be correlated.

In such an embodiments a frame of the spatial audio centre channel at time n, denoted as a(n), is zero padded to twice its length. Furthermore, a frame of the Lavalier microphone captured signal at time n, denoted as b(n), is also zero padded to twice its length. The cross correlation can be calculated as $$\mathrm{corr}(a(n),b(n))=\mathrm{ifft}(\mathrm{fft}(a(n))*\mathrm{conj}(\mathrm{fft}(b(n))))$$

where fft stands for the Fast Fourier Transform (FFT), ifft for its inverse, and conj denotes the complex conjugate.

A peak in the correlation value can be used to indicate a delay where the signals are most correlated, and this can be passed to a variable delay line to set the variable delay line with the amount with which the Lavalier microphone needs to be delayed in order to match the spatial audio captured audio signals.

In some embodiments various weighting strategies can be applied to emphasize the frequencies that are the most relevant for the signal delay estimation for the desired sound source of interest.

In some embodiments a position or location difference estimate from the position tracker 115 can be used as the initial delay estimate. More specifically, if the distance of the Lavalier source from the spatial audio capture device is d, then an initial delay estimate can be calculated. The frame where the correlation is calculated can thus be positioned such that its centre corresponds with the initial delay value.

In some embodiments the variable delay compensator 117 comprises a variable delay line. The variable delay line may be configured to receive the audio signal from the Lavalier microphone 111 and delay the audio signal by the delay value estimated by the time delay estimator. In other words when the 'optimal' delay is known, the signal captured by the Lavalier microphone is delayed by the corresponding amount.

The delayed Lavalier microphone 111 audio signals may then be output to be stored or processed as discussed herein.

The capture apparatus 101 may furthermore comprise a camera or cameras 107 configured to generate images. The camera or cameras may be configured to generate a panoramic image or video of images which is captured along with the spatial audio. The camera 107 may thus in some embodiments be part of the same apparatus configured to capture the spatial audio signals, for example a mobile phone or user equipped with a microphone array and a camera or cameras.

In some embodiments the camera may be equipped with or augmented with a depth-sensing means. For example the camera may be a 'Kinect' system, a time of flight camera, stereo cameras, or camera arrays used to generate images which may be analysed and from image disparity from multiple images a depth or 3D visual scene may be created.

The images may be passed to an analyser 109.

The capture apparatus 101 may comprise an analyser 109. The analyser 109 in some embodiments is configured to receive the images from the camera 107 and the audio signals from the variable delay compensator 117. Furthermore the analyser 109 is configured to generate source and space parameters from the received inputs. The source and space parameters can be passed to the render apparatus 103.

In some embodiments the render apparatus 103 comprises a head tracker 123. The head tracker 123 may be any suitable means for generating a positional input, for example a sensor attached to a set of headphones configured to monitor the orientation of the listener, with respect to a defined or reference orientation and provide a value or input which can be used by the audio renderer 120. The head tracker 123 may in some embodiments be implemented by at least one gyroscope and/or digital compass.

The render apparatus 103 comprises an audio renderer 121. The audio renderer 121 is configured to receive the audio signals, positional information and furthermore the source and space parameters from the capture apparatus 101. The audio renderer 121 can furthermore be configured to receive an input from the head tracker 123. Furthermore the audio renderer 121 can be configured to receive other user inputs. The audio renderer 121, as described herein in further detail later, can be configured to mix together the audio signals, the Lavalier microphone audio signals and the spatial audio signals based on the positional information, the head tracker inputs and the source and space parameters in order to generate a mixed audio signal. The mixed audio signal can for example be passed to headphones 125. However the output mixed audio signal can be passed to any other suitable audio system for playback (for example a 5.1 channel audio amplifier).

In some embodiments the audio renderer 121 may be configured to perform spatial audio processing on the audio signals from the microphone array and from the close microphone The Lavalier audio signal from the Lavalier microphone and the spatial audio captured by the microphone array and processed with the spatial analysis may in some embodiments be combined by the audio renderer to a single binaural output which can be listened through headphones.

In the following examples the spatial audio signal is converted into a multichannel signal. The multichannel output may then be binaurally rendered, and summed with binaurally rendered Lavalier source signals.

The rendering may be described initially with respect to a single (mono) channel, which can be one of the multichannel signals from the spatial audio signal or one of the Lavalier sources. Each channel in the multichannel signal set may be processed in a similar manner, with the treatment for Lavalier audio signals and multichannel signals having the following differences:

1) The Lavalier audio signals have time-varying location data (direction of arrival and distance) whereas the multichannel signals are rendered from a fixed location.

2) The ratio between synthesized "direct" and "ambient" components may be used to control the distance perception for Lavalier sources, whereas the multichannel signals are rendered with a fixed ratio.

3) The gain of Lavalier signals may be adjusted by the user whereas the gain for multichannel signals is kept constant.

Figure 8:
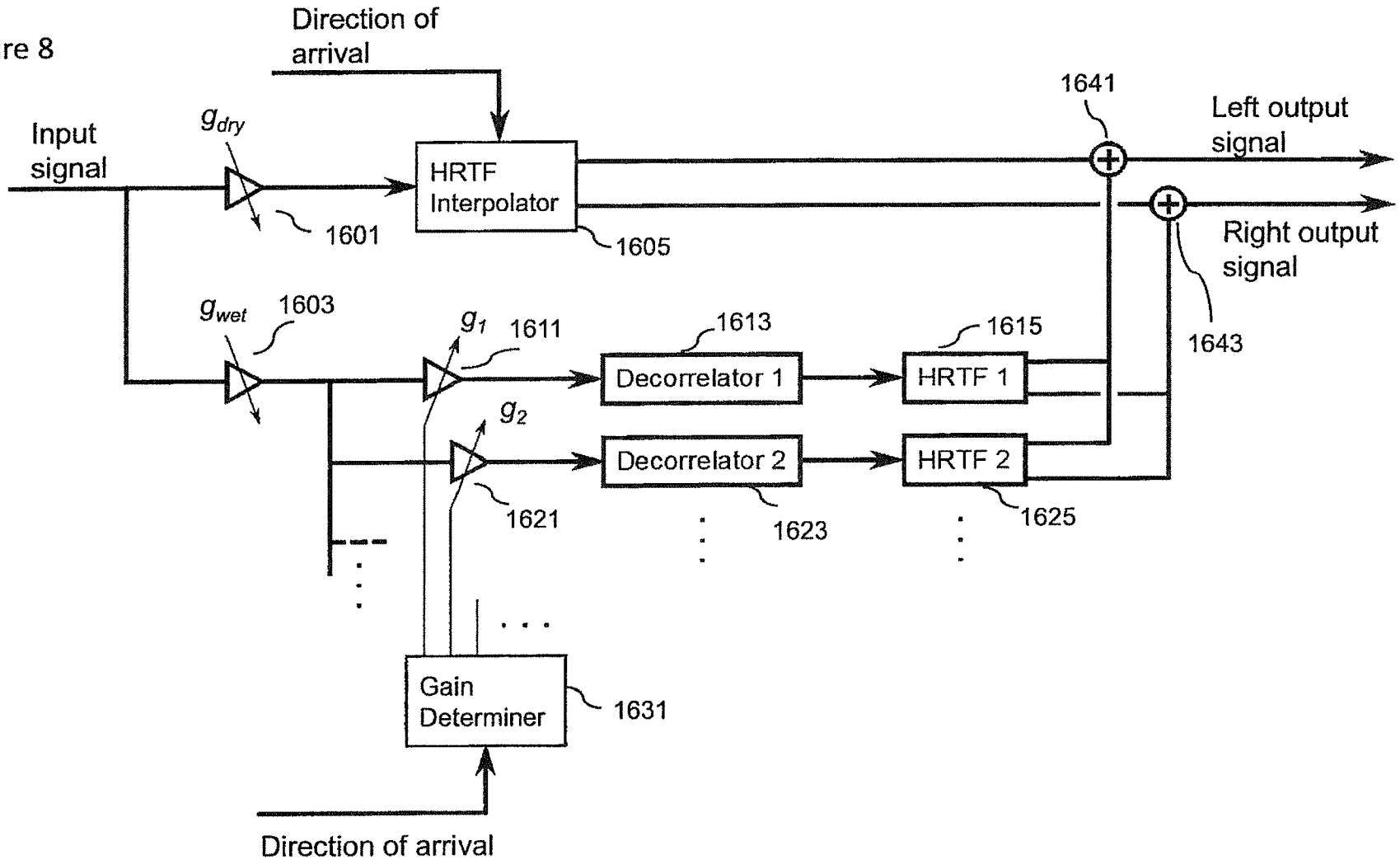
FIG. 8 shows an example rendering apparatus shown in FIG. 1 according to some embodiments.

With respect to FIG. 8 an example audio renderer 121 or render apparatus 103 is shown in further detail with respect to the an example rendering for a single mono channel, which can be one of the multichannel signals from the SPAC or one of the Lavalier sources.

The aim of the audio renderer is to be able to produce a perception of an auditory object in the desired direction and distance. The sound processed with this example is reproduced using headphones. In some embodiments a normal binaural rendering engine is employed together with a specific decorrelator. The binaural rendering engine produces the perception of direction. The decorrelator engine may comprise several static decorrelators convolved with static head-related transfer functions (HRTF) to produce the perception of distance. This may be achieved by causing fluctuation of inter-aural level differences (ILD), which have been found to be required for externalized binaural sound. When these two engines are mixed in a right proportion, the result is a perception of an externalized auditory object in a desired direction.

The examples shown herein employ static decorrelation engines. The input signal may be routed to each decorrelator after multiplication with a certain direction-dependent gain. The gain may be selected based on how close the relative direction of the auditory object is to the direction of the static decorrelator. As a result, interpolation artifacts, when rotating the head, may be avoided while still having directionality for the decorrelated content, which has been found to improve the quality of the output.

The audio renderer shown in FIG. 8 shows a mono audio signal input and a relative direction of arrival input. In some embodiments the relative direction is determined based on a determined desired direction in the world coordinate system (based on the relative direction between the spatial capture array and the Lavalier microphone) and an orientation of the head (based on the headtracker input).

The upper path of FIG. 8 shows a conventional binaural rendering engine. The input signal is passed via an amplifier 1601 applying a $g_{dry}$ gain to a head related transfer function (HRTF) interpolator 1605. The HRTF interpolator 1605 may comprise a set of head-related transfer functions (HRTF) in a database and from which HRTF filter coefficients are selected based on the direction of arrival input. The input signal may then be convolved with the interpolated HRTF to generate a left and right HRTF output which is passed to a left output combiner 1641 and a right output combiner 1643.

The lower path of FIG. 8 shows the input signal being passed via a second amplifier 1603 applying a $g_{wet}$ gain to a number of decorrelator paths. In the example shown in FIG. 6 there are shown two decorrelator paths, however it is understood that any number of decorrelator paths may be implemented. The decorrelator paths may comprise a decorrelator amplifier 1611, 1621 which is configured to apply a decorrelator gain $g_1$, $g_2$. The decorrelator gains $g_1$, $g_2$ may be determined by a gain determiner 1631.

The decorrelator path may further comprise a decorrelator 1613, 1623 configured to receive the output of the decorrelator amplifier 1611, 1621 and decorrelate the signals. The decorrelator 1613, 1623 can basically be any kind or type of decorrelator. For example a decorrelator configured to apply different delays at different frequency bands, as long as there is a pre-delay in the beginning of the decorrelator. This delay should be at least 2 ms (i.e., when the summing localization ends, and the precedence effect starts).

The decorrelator path may further comprise a HRTF filter 1615, 1625 configured to receive the output of the decorrelator 1613, 1623 and apply a pre-determined HRTF. In other words the decorrelated signals are convolved with pre-determined HRTFs, which are selected to cover the whole sphere around the listener. In some embodiments an example number of the decorrelator paths is 12 (but may be in some embodiments between about 6 and 20).

Each decorrelator path may then output a left and right path channel audio signal to the left output combiner 1641 and a right output combiner 1643.

The left output combiner 1641 and a right output combiner 1643 may be configured to receive the 'wet' and 'dry' path audio signals and combine them to generate a left output signal and a right output signal.

The gain determiner 1631 may be configured to determine a gain $g_i$ for each decorrelator path based on the direction of the source, for example using the following expression:

$$g_i=0.5+0.5(S_xD_{x,i}+S_yD_{y,i}+S_zD_{z,i})$$

where $S=[S_xS_yS_z]$ is the direction vector of the source and $D_i=[D_{x,i}D_{y,i}D_{z,i}]$ is the direction vector of the HRTF in the decorrelator path i.

In some embodiments the amplifier 1601 applying a $g_{dry}$ gain and the second amplifier 1603 applying a $g_{wet}$ gain may be controlled such that the gain for the "dry" and the "wet" paths can be selected based on how "much" externalization is desired. The ratio of the gains affect the perceived distance of the auditory object. In practice, it has been noticed that good values include $g_{dry}=0.92$ and $g_{wet}=0.18$. It should be noted that the number of decorrelator paths furthermore affects the suitable value for $g_{wet}$.

Furthermore, as the ratio between $g_{dry}$ and $g_{wet}$ affects the perceived distance, controlling them can be used for controlling the perceived distance.

Figure 10:
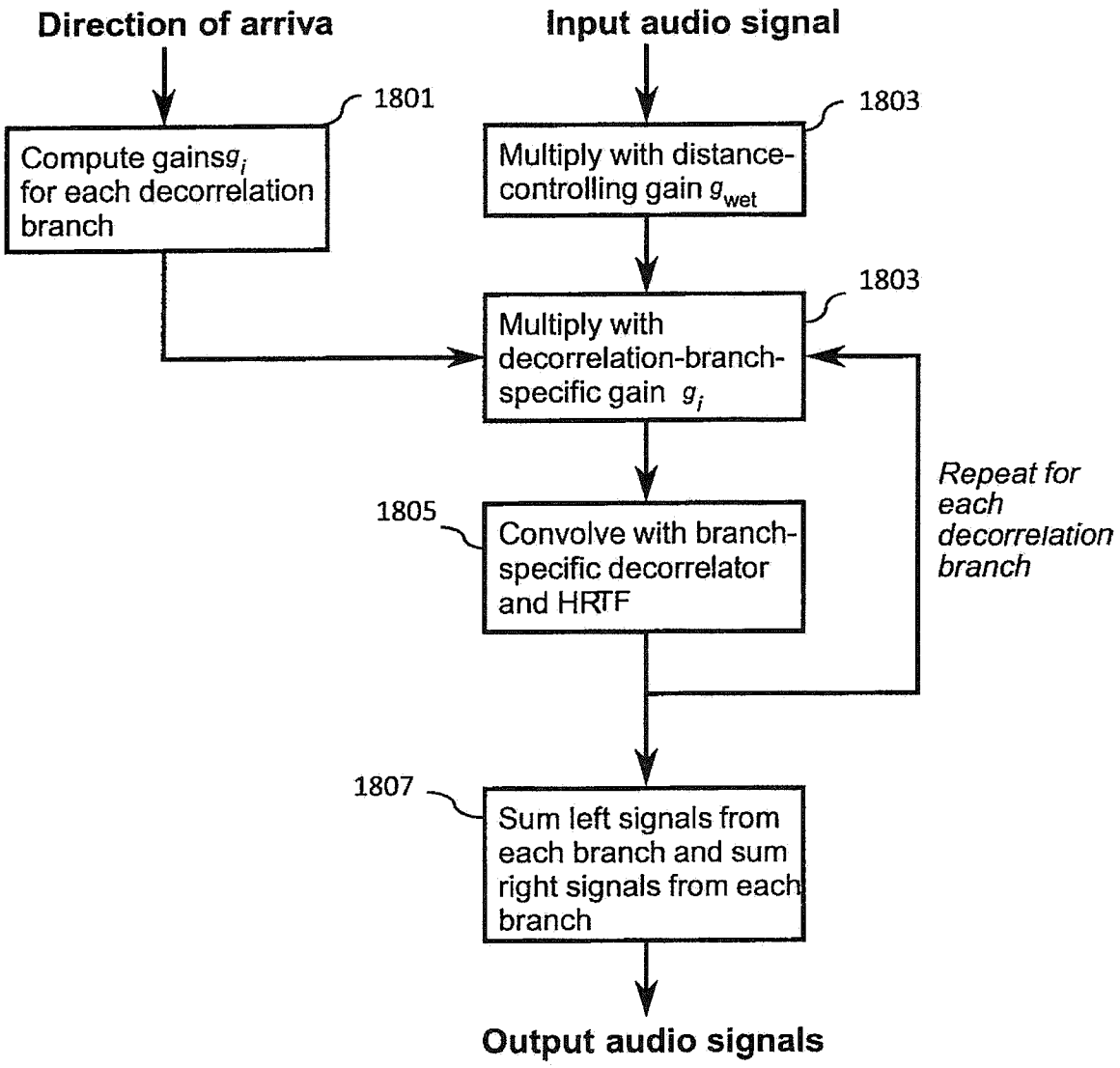
FIG. 10 shows a flow diagram of the operation of the rendering apparatus shown in FIG. 8 according to some embodiments.

The operations of the lower path of FIG. 8 are shown in FIG. 10.

The method of the lower path may comprise receiving the direction of arrival parameter.

The method may the further comprise computing or determining the decorrelator amplifier gains $g_i$ for each decorrelation path or branch.

The operation of computing or determining the decorrelator amplifier gains $g_i$ for each decorrelation path or branch is shown in FIG. 10 by step 1801.

Furthermore in some embodiments in parallel with the receiving the direction of arrival parameter the method furthermore comprises receiving the input audio signal.

The method may further comprise multiplying the received audio signal by the distance controlling gain $g_{wet}$.

The operation of multiplying the input audio signal with the distance controlling gain $g_{wet}$ is shown in FIG. 10 by step 1803.

The method may furthermore comprise multiplying the output of the previous step with the decorrelation-branch or decorrelation-path specific gain calculated in step 1801.

The operation of multiplying the output of the previous step with the decorrelation-branch or decorrelation-path specific gain is shown in FIG. 10 by step 1803.

The method may furthermore comprise convolving the output of the previous step with the branch (or path) specific decorrelator and applying the decorrelation branch or path predetermined HRTF.

The operation of convolving the decorrelation branch specific amplifier output with the branch (or path) specific decorrelator and applying the decorrelation branch or path predetermined HRTF is shown in FIG. 10 by step 1805.

The steps of multiplying the output of the previous step with the decorrelation-branch or decorrelation-path specific gain and convolving the output with the branch (or path) specific decorrelator and applying the decorrelation branch or path predetermined HRTF may then be repeated for each decorrelation branch as shown by the loop arrow.

The outputs of each branch left signals may be summed and the outputs of each branch right signals may be summed to be further combined with the 'dry' binaural left and right audio signals to generate a pair of output signals The operation of summing each branch left signals and summing each branch right signals is shown in FIG. 10 by step 1807.

Figure 9:
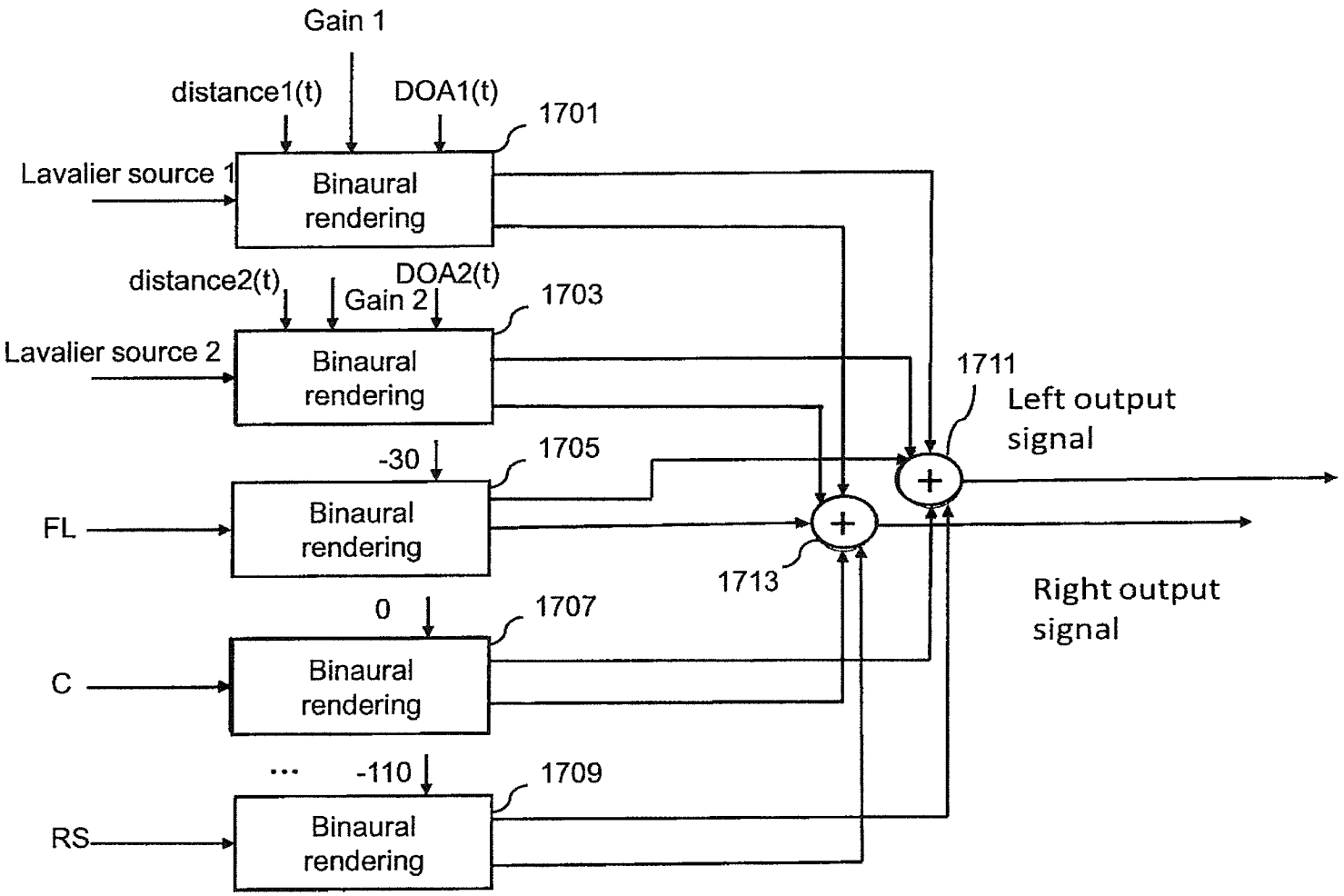
FIG. 9 shows schematically a further example rendering apparatus as shown in FIG. 1 according to some embodiments.

FIG. 9 shows the audio renderer configured to render the full output. The full output in this example comprising one or more Lavalier signals and in this example two Lavalier signals and furthermore comprising the output of the spatial audio signal in a 5.1 multichannel signal format.

In the example audio renderer shown there are seven renderers of which five binaural renderers are shown. Each binaural renderer may be similar to the binaural renderer example shown in FIG. 6 configured to render a single or mono channel audio signal. In other words each of the binaural renders 1701, 1703, 1705, 1707, and 1709 may be the same apparatus as shown in FIG. 8 but with a different set of inputs such as described herein.

In the example shown in FIG. 9 there are two Lavalier sourced audio signals. For the Lavalier signals, the direction of arrival information is time-dependent, and obtained from the positioning methods as described herein. Moreover, the determined distance between the Lavalier microphone and the microphone array for capturing the spatial audio signal is used to control the ratio between the 'direct/dry' and 'wet' paths, with a larger distance increasing the proportion of the "wet" path and decreasing the proportion of "direct/dry". Correspondingly, the distance may affect the gain of the Lavalier source, with shorter distance increasing the gain and a larger distance decreasing the gain. The user may furthermore be able to adjust the gain of Lavalier sources. In some embodiments the gain may be set automatically. In the case of automatic gain adjustment, the gain may be matched such that the energy of the Lavalier source matches some desired proportion of the total signal energy. Alternatively or in addition to, in some embodiments the system may match the loudness of each Lavalier signal such that it matches the average loudness of other signals (Lavalier signals and multichannel signals).

Thus in some embodiments the inputs to a first Lavalier source binaural renderer 1701 are the audio signal from the first Lavalier microphone, the distance from the first Lavalier microphone to the microphone array for capturing the spatial audio signals, the first gain for signal energy adjustment or for focusing on the source, and a first direction of arrival based on the orientation between the first Lavalier microphone to the microphone array for capturing the spatial audio signals. As described herein the first direction of arrival may be further based on the user input such as from the head tracker.

Furthermore in some embodiments the inputs to a second Lavalier source binaural renderer 1703 are the audio signal from the second Lavalier microphone, the distance from the second Lavalier microphone to the microphone array for capturing the spatial audio signals, the second gain for signal energy adjustment or for focusing on the source, and a second direction of arrival based on the orientation between the second Lavalier microphone to the microphone array for capturing the spatial audio signals. As described herein the second direction of arrival may be further based on the user input such as from the head tracker.

Furthermore there are 5 further binaural renderers (of which the front left, centre and rear surround (or rear right) are shown. The spatial audio signal is therefore represented in a 5.1 multichannel format and each channel omitting the low-frequency channel is used as a single audio signal input to a respective binaural renderer. Thus, the signals and their directions of arrival are front-left: 30 degrees
center: 0 degrees
front-right −30 degrees
rear-left: 110 degrees
rear-right: −110 degrees The output audio signals from each of the renderers may then be combined by a left channel combiner 1711 and a right channel combiner 1713 to generate the binaural left output channel audio signal and the right output channel audio signal.

It is noted that the above is an example only. For example, the Lavalier sources and the spatial audio captured by the SPAC may be rendered differently.

For example, a binaural downmix may be obtained of the spatial audio and each of the Lavalier signals, and these could then be mixed. Thus, in these embodiments the captured spatial audio signal is used to create a binaural downmix directly from the input signals of the microphone array, and this is then mixed with a binaural mix of the Lavalier signals.

In some further embodiments, the Lavalier audio signals may be upmixed to a 5.1 multichannel output format using amplitude panning techniques.

Furthermore in some embodiments the spatial audio could also be represented in any other channel-based format such as 7.1 or 4.0. The spatial audio may also be represented in any known object-based format, and stored or transmitted or combined with the Lavalier signals to create an object-based representation.

In such embodiments the (time delayed) audio signal from the close microphone may be used as a mid-signal (M) component input. Similarly the spatial audio signal used as the side-signal (S) component input. The position or tracking information may be used as the direction information ($\alpha$) input. In such a manner any suitable spatial processing applications implementing the mid-side-direction (M-S-$\alpha$) spatial audio convention may be employed using the audio signals. For example spatial audio processing such as featured in US20130044884 and US2012128174 may be implemented.

Similarly the audio renderer 121 may employ rendering methods and apparatus such as featured in known spatial processing (such as those explicitly featured above) to generate suitable binaural or other multichannel audio format signals.

The audio renderer 121 thus in some embodiments may be configured to combine the audio signals from the close or Lavalier sources and the audio signals from the microphone array. These audio signals may be combined to a single binaural output which can be listened through headphones.

The render apparatus 103 in some embodiments comprises headphones 125. The headphones can be used by the listener to generate the audio experience using the output from the audio renderer 121.

Thus based on the source and space parameters, the Lavalier microphone signals can be mixed and processed into the spatial audio field. The rendering furthermore in some embodiments can be implemented furthermore based on the source position and the headtracking input. In some embodiments the rendering is implemented by rendering the spatial audio signal using virtual loudspeakers with fixed positions, and the captured Lavalier source is rendered from a time varying position. Thus, the audio renderer 121 may in some embodiments be configured to control the azimuth, elevation, and distance of the Lavalier or close source based on the tracked position data.

Moreover, the user may be allowed to adjust the gain and/or spatial position of the Lavalier source using the output from the head-tracker 123. For example the head-tracker input may be used to improve the quality of binaural reproduction. Alternatively to a binaural rendering (for headphones), a spatial downmix into a 5.1 channel format or other format could be employed. In this case, the Lavalier or close source can in some embodiments mixed to its 'proper' spatial position using known amplitude panning techniques.

Figure 2A:
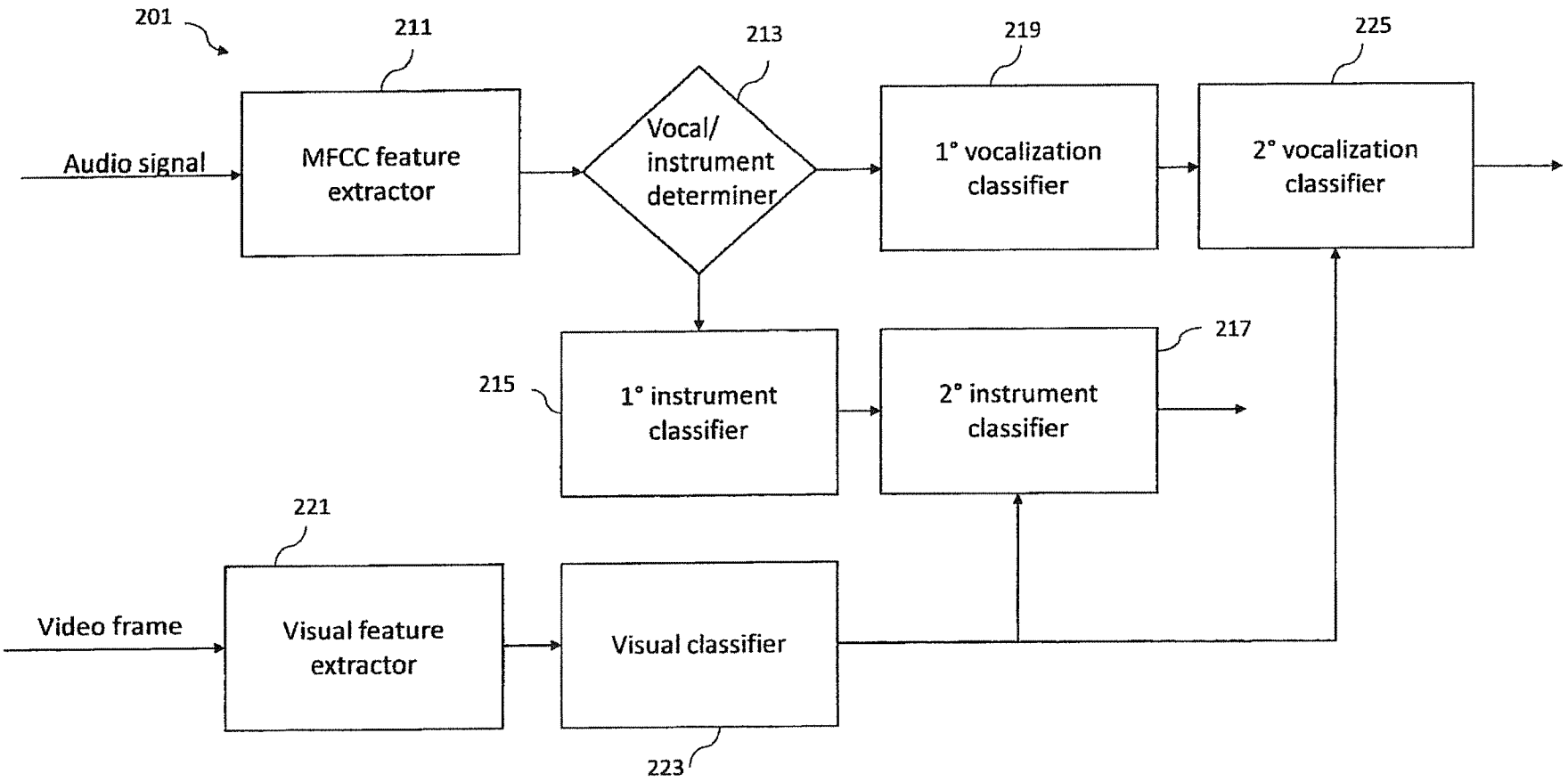
FIG. 2*a* shows schematically a source analyser implemented within the content analyser as shown in FIG. 1 according to some embodiments.

With respect to FIG. 2*a* an example of source analyser 201 implemented within the analyser 109 is shown in further detail. The source analyser 201 is configured to perform content analysis to classify the source. For example the classification may determine the type of sound source.

The input to the source analyser is the Lavalier microphone audio signal. In some embodiments the source analyser 201 may optionally receive the spatial audio signal, the image (video) frame from the camera, and optionally also depth data.

The source analyser 201 may be configured to first classify the audio signal by an audio classifier to determine the most likely human vocalization types and instrument types. Correspondingly, the video frame may be first analysed by a visual analyser to determine the most likely human categories and instrument types. The output of these first level or primary classifiers may be fed to a second level or secondary classifier, which makes a final decision on the source identity.

Alternatively in some embodiments the source analyser 201 may be a single multi-modal classifier which takes in all the input data types (audio, video, depth) and directly outputs the final decision.

In some embodiments the source analyser 201 comprises a mel-frequency cepstral coefficient (MFCC) feature extractor 211. The MFCC feature extractor 211 in some embodiments is configured to receive the audio signal input and generate mel-frequency cepstral coefficients and their first-order time-derivatives.

The MFCC feature extractor 211 may be generated in short frames of the signal. For example frame lengths of the order 20 ms and 40 ms are suitable for the task. The MFCC analysis may comprise calculating the power spectrum for each frame with the help of the Fast Fourier Transform (FFT). Then the MFCC feature extractor may be configured to apply a mel filterbank to the power spectra by summing the power spectrum bins belonging to each channel to obtain the channel energies. The MFCC feature extractor 211 may then take the natural logarithm of the filterbank energies and apply a Discrete Cosine Transform (DCT) to the log filterbank energies. In some embodiments the MFCC feature extractor may then retain the first 20 DCT coefficients but discarding the zeroth which corresponds to the channel gain.

Furthermore the first-order time-derivative of the MFCC may be obtained by the MFCC feature extractor 211 as the slope of a 5-point line fit on the temporal trajectory of each MFCC coefficient.

The MFCC feature extractor 211 may then be configured to generate a feature vector for each frame comprising the 20 static MFCC coefficients along with the 20 derivative coefficients.

In some embodiments the MFCC feature extractor 211 may be replaced by any suitable features which have been previously learned from training data.

The feature vector may then be passed to the vocal/instrument determiner 213.

The source analyser 201 may in some embodiments comprise a vocal/instrument determiner 213. The vocal/instrument determiner is configured to receive the extracted feature vector and determine whether the frame is either of the categories human vocalization or instrument. In some embodiments this is obtained by training a support vector classifier to classify between these two classes. The class vocalization is trained with a database of human vocalizations, containing speech, singing, and other human-created sounds such as whistling. The class instrument is trained with a large database containing sounds of different musical instruments, in solo settings, either solo notes or solo music performances.

Where the vocal/instrument determiner 213 determines the frame is a human vocalization then the feature vector is passed to a primary vocalization classifier 219. Where the vocal/instrument determiner 213 determines the frame is an instrument then the feature vector is passed to a primary instrument classifier 215.

In some embodiments the source analyser 201 comprises a primary vocalization classifier 219. The primary vocalization classifier 219 may be configured to receive the feature vector and further classify the frame. For example the primary vocalization classifier 219 may be configured to classify the frame into male speech, female speech, male singing, female singing, child speech, child singing, other male vocalization, other female vocalization, other child vocalization. This classification can be done by training a Gaussian mixture model for each category above, using a database of annotated audio samples as training data.

This classification of the frame may then be passed to a secondary vocalization classifier 225.

In some embodiments the source analyser 201 comprises a primary instrument classifier 215. The primary instrument classifier 215 may be configured to receive the feature vector and further classify the frame. For example the primary instrument classifier 215 may be configured to classify the frame into: Accordion, Acoustic guitar, Banjos, Bass, Brass, Glockenspiel, Drums, Electric guitar, Keyboards, Percussion, Piano, Sax, Strings, Synthesizer and Woodwinds.

This classification may be performed using the methods as described in PCT/FI2014/051036, application filing date 22 Dec. 2014.

This classification of the frame may then be passed to a secondary instrument classifier 217.

In some embodiments the source analyser 201 comprises a visual feature extractor 221 configured to receive image data and extract suitable visual features which may be passed to the secondary instrument classifier 217 and the secondary vocalization classifier 225.

The visual feature extractor 221 may be configured to perform image analysis on the (panoramic) video or image data from the camera in order to recognize a category of objects residing in the direction of the Lavalier microphones.

For example in some embodiments the visual feature extractor 221 may be configured to extract visual feature elements which are passed to a visual classifier 223.

The visual features can be either hand-crafted or determined (such as spatio-temporal Interest Points) or automatically learned or determined from large video datasets.

In some embodiments the source analyser 201 comprises a visual classifier 223. The visual classifier 223 may be configured to receive the features extracted by the visual feature extractor and apply a visual object recognizer function to the features in order to determine an output classification. The visual object recognizer function may be developed by training visual object recognizers on a labelled dataset such as the ImageNet dataset or the PASCAL Visual Object Classes dataset. The recognizer function for example can be trained to recognize the categories [person] [male] [female] with respect to the 'vocal' categories and different musical instruments. For example, the recogniser function may for example be trained to recognize the same set of instrument categories as for the audio classifier as discussed above.

The visual classifier 223 may furthermore be able to classify the user activity which then be used for controlling several parameters in the audio rendering and mixing process. For example, if a person is speaking and eating (at alternate times), the system could apply an audio filter which emphasizes the voice over the eating noise (e.g., chewing noise). Furthermore, the association between audio mixing parameters and visual features can be automatically learned from training data, for example by performing regression analysis.

In some embodiments the visual classifier 223 may be configured to determine classifications of orientations of the object. For example determining and outputting the direction of the person's face with regard to the camera, whether they are facing the camera, facing sideways to the camera, or facing away from the camera. This information may be used for example for modulating the gain and/or ratio of direct to ambient sound parameter of the signal captured by the Lavalier microphone during the mixing process. For example, when the user is facing away from the camera, the sound may be made less loud and the proportion of indirect sound to direct sound may be increased.

In some embodiments the visual feature extractor 221 may be further configured to provide additional attributes to be used in the mixing. For example attributes or features which may be defined by the visual feature extractor 221 may be user activity (for example walking, running, or dancing).

These classifications can be performed by extracting either static visual features (in other words only from individual frames), or dynamic visual features (in other words information describing the motion of people and objects within adjacent frames).

These classifications may be passed to the secondary vocalization classifier 225 and the secondary instrument classifier 217 based on the classification results.

In some embodiments the source analyser 201 comprises a secondary vocalization classifier 225. The secondary vocalization classifier 225 may be configured to receive the outputs from the visual classifier 223 and the primary vocalization classifier 219.

In some embodiments the source analyser 201 comprises a secondary instrument classifier 217. The secondary instrument classifier 217 may be configured to receive the outputs from the visual classifier 223 and the primary instrument classifier 215.

The secondary level classifiers can be configured to determine a final decision on the source type based on both audio analysis and visual analysis. In some embodiments the secondary classifiers 217 (instrument), 225 (vocalization) can be implemented by a neural network classifier or a support vector machine, which takes as input the probabilities from the visual classifier and audio classifiers. The secondary level classifiers may be trained by using a set of annotated data as examples, and the probabilities of the visual and audio classifiers as features.

The secondary classifications may then be output.

Figure 2B:
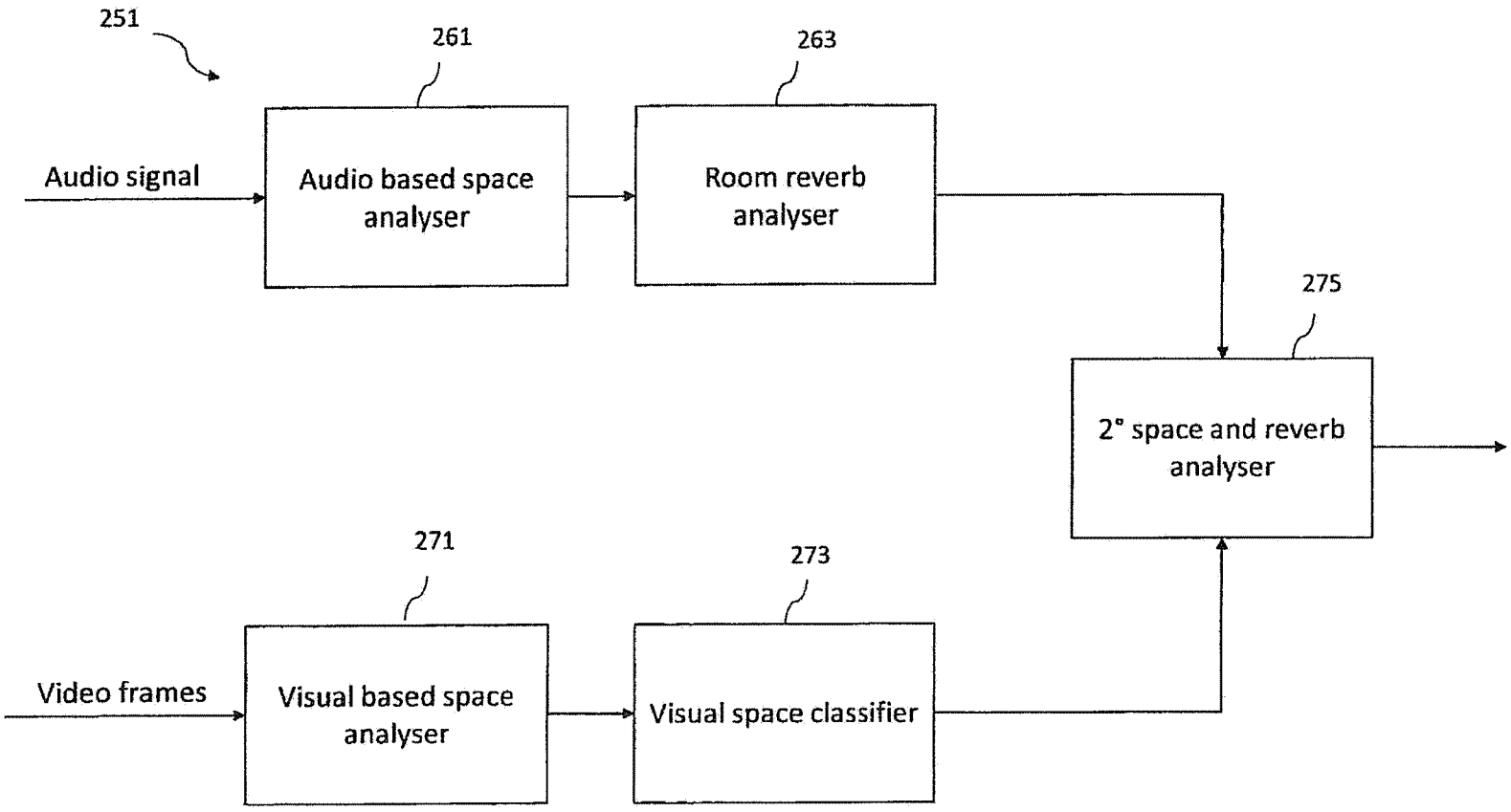
FIG. 2*b* shows schematically a space analyser implemented within the content analyser as shown in FIG. 1 according to some embodiments.

With respect to FIG. 2*b* an example of a space analyser 251 implemented within the analyser 109 is shown in further detail. The space analyser 251 is configured to perform content analysis to classify the space within which is located the source. For example the classification may determine the type of space.

In some embodiments the space analyser 251 comprises an audio based space analyser 261. The audio based space analyser 261 may be configured to receive the captured audio signals and analyse them to determine an audio signal suitable to pass to a room reverberation analyser 263.

In some embodiments the space analyser 251 comprises a room reverberation analyser 263. The room reverberation analyser 263 may be configured to receive the extracted audio signal components on which a reverberation time for the room may be determined. For example the reverberation time for the room may be determined according to the method by Sampo Vesa, Aki Härmä, "Automatic Estimation of Reverberation Time From Binaural Signals", In Proc. IEEE ICASSP Acoustics, Speech, and Signal Processing, 18-23 Mar. 2005. In such a method an estimate of the reverberation time (RT) at the space of usage can be measured based on locating suitable sound segments for RT analysis by using short-time energy and inter-channel coherence measures, followed by the Schroeder integration method, line fitting and finally statistical analysis. The line fitting is used to estimate the slope of the decay. The slope may be estimated in the region that maximizes the correlation coefficient of the least squares method and makes the estimation results more accurate than if fixed limits, e.g., −5 to −25 dB on the decay curve were used due to the absence of the systematic error caused by bending of the decay curves.

The reverberation time thus describes the room characteristics, with larger spaces having larger reverberation than smaller ones. However in outdoor environments there may not be any reverberation.

These values may be passed to the secondary space and reverberation analyser 275.

In some embodiments the space analyser 251 comprises a visual based space analyser 271. The visual based space analyser 271 may be configured to receive the captured images from the camera determine suitable features of parameters from the images which can be passed to a visual space classifier 273.

In some embodiments the space analyser 251 comprises a visual space classifier 273. In a manner similar to recognizing visual objects, a visual classifier is trained to classify different venues for sound capture. For example the visual space classifier 273 may be configured to classify the visual image as being one of stadiums, concert halls, different rooms, outdoor environments and the like.

In some embodiments it is assumed that the space does not change in time during the image capture process and thus can be done by classifying static features from a number of sampled frames. However in some embodiments where the space changes (for example when capturing a theatre act where the choreography may change the space characteristics), then feature-extraction and classification may be performed at regular intervals or based on visual-change-detection results.

The classification results from the visual space classifier 273 may then be passed to a secondary space and reverberation analyser 275.

In some embodiments the space analyser 251 comprises a secondary space and reverberation analyser 275. The secondary space and reverberation analyser 275 may be configured to receive the visual space classification results and the output of the room reverberation analyser 263. The secondary space and reverberation analyser in some embodiments is configured to output a secondary or final classification of the space. For example the final classification may be determined by applying the inputs to a neural network trained with features from the visual space classifier and the audio-based reverberation time estimator.

The secondary space and reverberation analyser 275 may thus output a final decision as to the type of the space (indoor, outdoor, small room, medium room, large room, church, stadium, small concert hall, medium concert hall, large concert hall) and the reverberation time in seconds.

The purpose of the secondary space and reverberation analyser 275 may be to improve the accuracy of the space categorization and the reverberation time estimation, compared to the case if either of the visual or audio-based estimates would be used alone.

Figure 3:
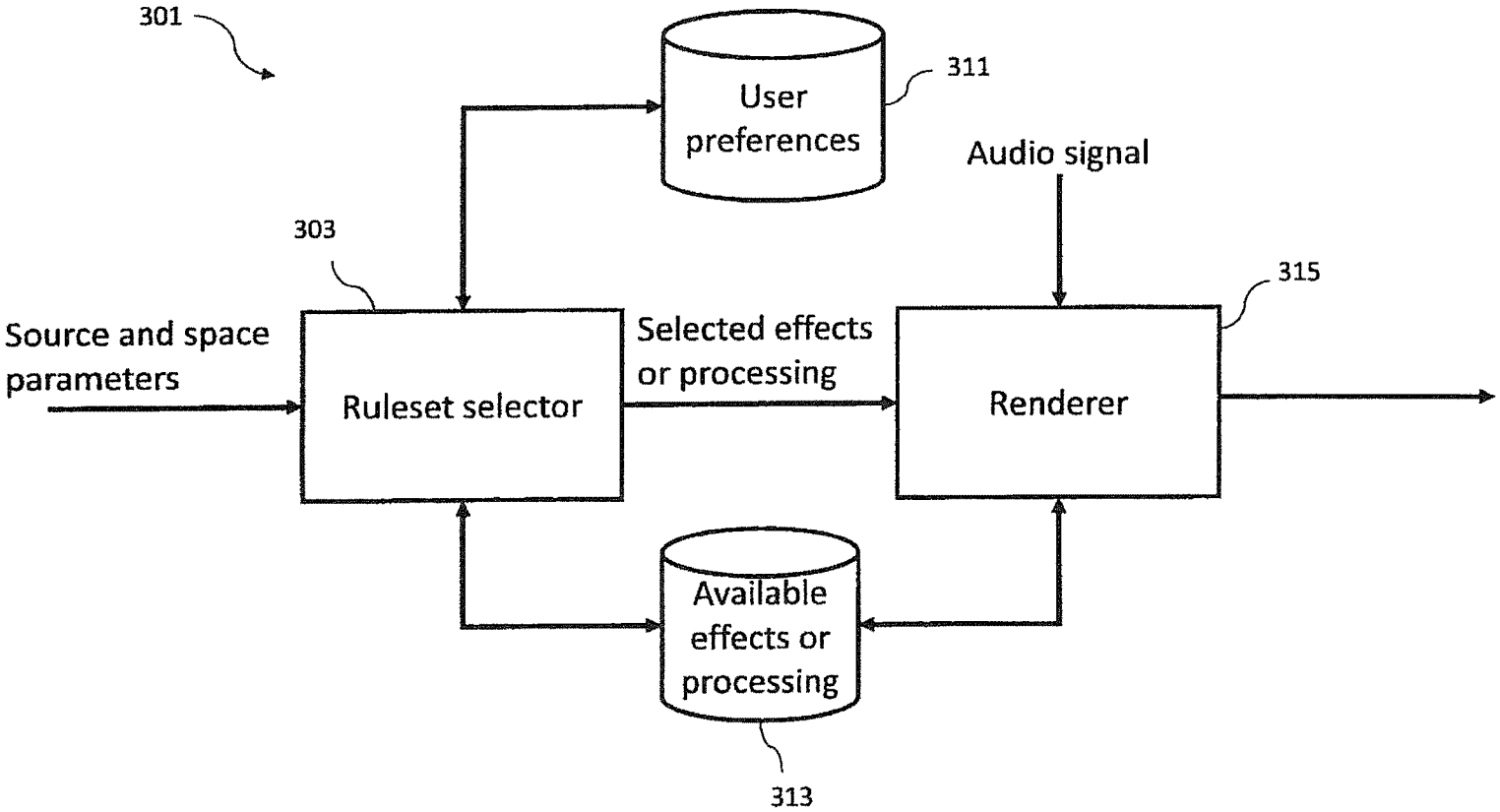
FIG. 3 shows schematically an example audio renderer as shown in FIG. 1 according to some embodiments.

With respect to FIG. 3 an example render apparatus 103 according to some embodiments is shown.

The render apparatus 103 in some embodiments comprises a ruleset selector 303. The ruleset selector 303 may be configured to receive the determined classifications or the source and space parameters as determined by the analyser 109 within the capture apparatus. Furthermore the ruleset selector 303 may be configured to interact with a user interface and/or memory in order to retrieve a set of user preferences 311 with respect to the processing or rendering operations.

The ruleset selector 303 may furthermore be configured to interact with a memory to determine available effects or processing 313 routines or codes which may be implemented.

The ruleset selector 303 may thus obtain as an input the information of the category of the sources and the space. This information is signalled in the example shown in FIG. 1 by the audio capture device (Lavalier microphones, Spatial Audio Capture device, etc.) but may in some embodiments be signalled by a dedicated audio source and space (environment) analyser. The dedicated analyser may in some embodiments be a device separate from the capture apparatus 101 and the render apparatus 103, for example a cloud based, or server based analyser. Furthermore in some embodiments the dedicated analyser may be collocated with the audio mixer/renderer apparatus.

In some embodiments the category information may be an indication of the form source_type: female singing
source_style: normal singing
source_loudness: 90 space_type: medium room
reverberation_time: 0.8 seconds
activity_type: dancing
facing_camera: true Thus in this example the source type in terms of whether the source is an instrument or vocalisation and the sub-category of the type of voice or instrument is defined in the field source_type. The source style field, source_style, further defines the source. The source loudness field, source_loudness, defines the volume or power of the source. The space type field, space_type, defines the type of environment in which the source is located. The reverberation time field, reverberation_time, defines the reverberation time for the room or environment. The activity type field, activity_type, defines the type of activity or expected motion of the source. Furthermore the facing camera field, facing_camera, defines whether the source is located towards the camera and thus indicates whether the source is facing towards or away from the microphone array capturing spatial audio signals.

In some embodiments the information may be encapsulated in a suitable XML/SDP/JSON format for signalling this information over a suitable transport format like SIP/HTTP/RTSP or any suitable transport protocol.

In some embodiments the ruleset selector may be configured to determine from a stored ruleset which defines what type of processing to apply in different situations suitable processing or effects which may be applied based on the signalled source and space parameters.

For example, a simple ruleset applied by the ruleset selector 303 may determine that for speech source types no effects are applied. Similarly the ruleset selector 303 may determine that for singing source types a reverb effect may be enabled. Furthermore the ruleset selector 303 may determine a setting instructing the amount of reverb is to be controlled based on the space type and/or the reverberation time.

For example, some reverberation implementations such as the freeverb (https://ccrma.stanford.edu/~jos/pasp/Freeverb.html) allow providing the size of a simulated room as a percentage. For example, 0% may correspond to a closet and 100% to a huge cathedral or large auditorium. The space type and/or reverberation time may be mapped to a percentage and provided to the reverb algorithm, and used to process the Lavalier source.

In some embodiments the orientation of the source relative to the spatial capture microphone (as indicated in the example above by the facing_camera field) may be used to define a ruleset to change the amount of indirect sound (audio ambiance) in the final mix. This may be done by adjusting the ratio between the direct gain $g_{dry}$ and wet gain $g_{wet}$ of the rendering method such as described herein.

In some embodiments the determination of the possible effects or processing to be applied by the renderer as defined by the ruleset selector 303 may furthermore be based on user preferences. In some embodiments the ruleset selector 303 may be configured to operate initially according to initial or 'factory' settings, but the user can then customise according to their own preferences.

The ruleset selector 303 may be configured to enable any suitable effect or process based on the source and space parameters. For example other effects such as delay or auto-tune may be implemented. For example, the ruleset selector 303 may define that whenever the input source is indicated as being a singing source (male, female, or child), then an auto-tune effect is applied. As another example, if the user activity is running or dancing, it is likely that the motion will have an effect on the singing performance. In this case, the ruleset selector 303 may be configured to enable auto-tune and possibly noise cancellation processing in order to increase singing purity and remove some of the unwanted noise caused by the dancing/moving activity.

Furthermore in some embodiments the ruleset selector 303 may be configured to change or define effect settings based on the source and/or space parameters. For example the effect settings may be determined to be based on the singing/speaking loudness and style. Thus for example where the ruleset selector 303 determines the source is a style including 'normal singing', 'falsetto singing', and 'growling' then the ruleset selector 303 may determine that compression settings depend on the singing volume. As another example, where the ruleset selector 303 determines the source is a style including 'normal singing', 'falsetto singing', and 'growling' then the ruleset selector 303 may determine that the settings or the range of available settings for the autotune effect differ where the source is a 'normal singing' type or is a 'falsetto singing' type. Furthermore the ruleset selector 303, in the same example, may determine that autotune may be completely bypassed in 'growling' singing.

Similarly the ruleset selector 303 may be configured to select a set of effects to be applied (and the settings or settings range available for the effect) based on the instrument identity, such that the effects which are defined are suitable for that instrument and/or the space within which the instrument is being played.

These defined or selected rulesets can be passed to a renderer processor 315.

In some embodiments the renderer apparatus 103 comprises a renderer processor 315. The renderer processor 315 may be configured to receive the selected effects or processing as defined by the ruleset selector 303, the available effects or processing code or routines 313 and the audio signals to be rendered.

The render apparatus 103 may then be configured to generate a mix or rendering of the audio signals (the Lavalier or close audio source audio signals and the spatial audio signals) and furthermore to apply any suitable processing or effects as defined by the ruleset selector 303 based on at least the Lavalier or close audio source audio signals.

The rendered audio signals may then be output, as discussed herein to a suitable audio signal presentation output, such as a headset or headphones or to a surround sound apparatus for generating an audio experience from the rendered audio signals.

With respect to FIGS. 4 to 7 example flow diagrams showing the operations of the components described above are shown.

Figure 4:
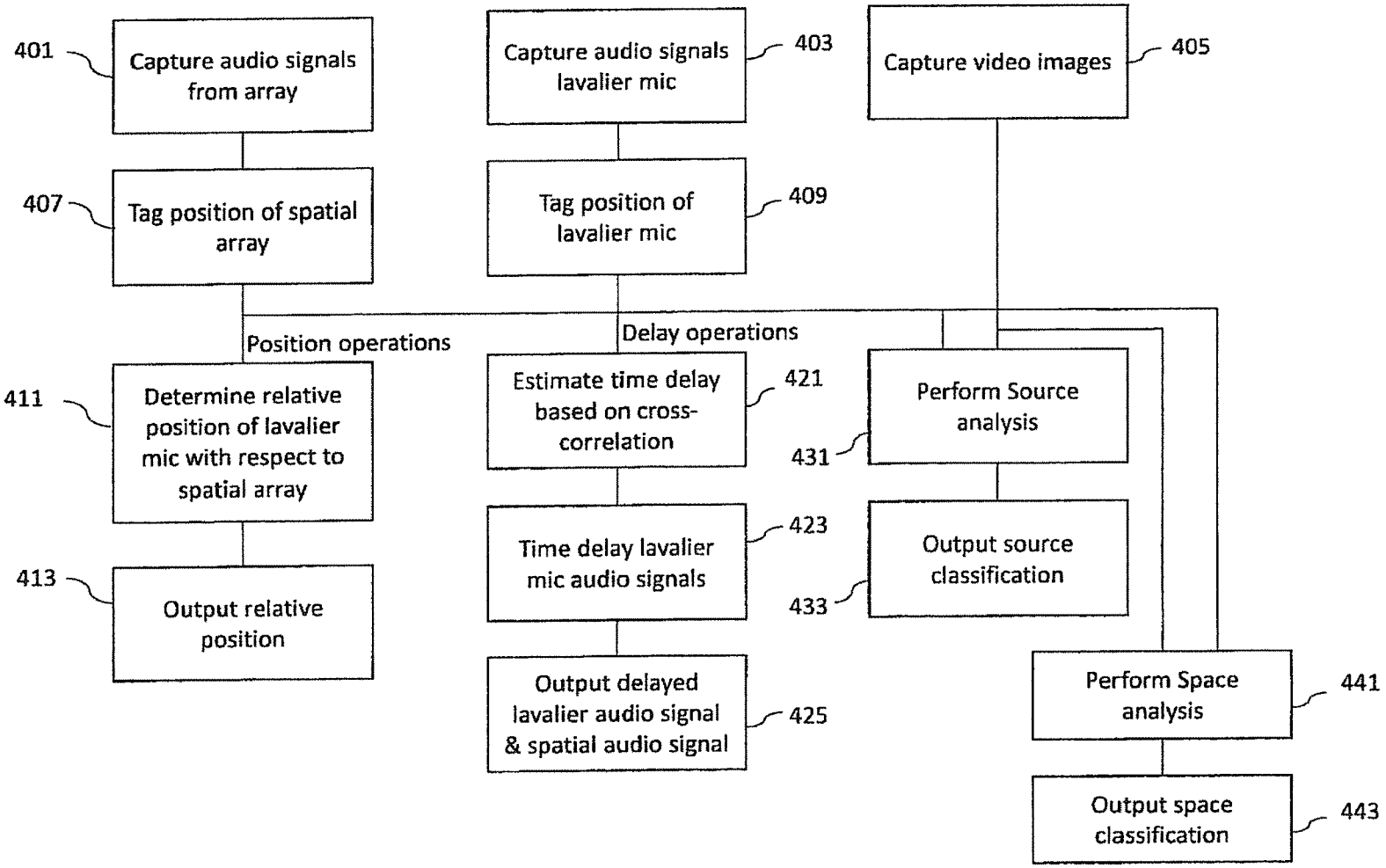
FIG. 4 shows a flow diagram of the operation of the example capture apparatus as shown in FIG. 1 according to some embodiments.

For example FIG. 4 shows a flow diagram of the audio capture and analysis operations.

In some embodiments the capture apparatus is configured to capture audio signals from the spatial array of microphones.

The operation of capturing audio signals from the spatial array is shown in FIG. 4 by step 401.

Furthermore the capture apparatus is further configured to tag or determine the position of the spatial array.

The operation of tagging or determining the position of the spatial array is shown in FIG. 4 by step 407.

In some embodiments the capture apparatus is configured to capture audio signals from the Lavalier microphone.

The operation of capturing audio signals from the Lavalier microphone is shown in FIG. 4 by step 403.

Furthermore the capture apparatus is further configured to tag or determine the position of the Lavalier microphone.

The operation of tagging or determining the position of the Lavalier microphone is shown in FIG. 4 by step 409.

The capture apparatus may then using the tag or position information determine and track a relative position of the microphone with respect to the spatial array.

The operation of determining and tracking the relative position of the Lavalier or close microphone with respect to the spatial audio capture device or spatial array is shown in FIG. 4 by step 411.

The relative position of the Lavalier or close microphone relative to the spatial audio capture device or spatial array can then be output (to the render apparatus 103).

The operation of outputting the determined or tracked relative position is shown in FIG. 4 by step 413.

The capture apparatus may then generate an estimate of the time delay between the audio signals. This time delay may be based on a cross correlation determination between the signals.

The operation of generating an estimate of the time delay is shown in FIG. 4 by step 421.

The capture apparatus may apply the time delay to the Lavalier microphone audio signal.

The operation of applying the time delay to the Lavalier microphone audio signal is shown in FIG. 4 by step 423.

The capture apparatus may then output the time delayed Lavalier microphone audio signal and the spatial audio signal (to the render apparatus 103).

The operation of outputting time delayed Lavalier microphone audio signal and the spatial audio signal is shown in FIG. 4 by step 425.

The capture apparatus may furthermore capture video images.

The operation of capturing video images is shown in FIG. 4 by step 405.

The video images and audio signals may then be analysed to determine or classify the source or determine any parameters associated with the source.

The operation of performing a source analysis on the video images and the audio signals to identify and classify the source is shown in FIG. 4 by step 431.

The capture apparatus may then output the source parameters and/or classification to the render apparatus.

The operation of outputting the source parameters is shown in FIG. 4 by step 433.

The video images and audio signals may also be analysed to determine or classify the space within which the source is located or determine any parameters associated with the space.

The operation of performing a space analysis on the video images and the audio signals to identify and classify the space is shown in FIG. 4 by step 441.

The capture apparatus may then output the space parameters and/or classification to the render apparatus.

The operation of outputting the space parameters is shown in FIG. 4 by step 443.

Figure 5:
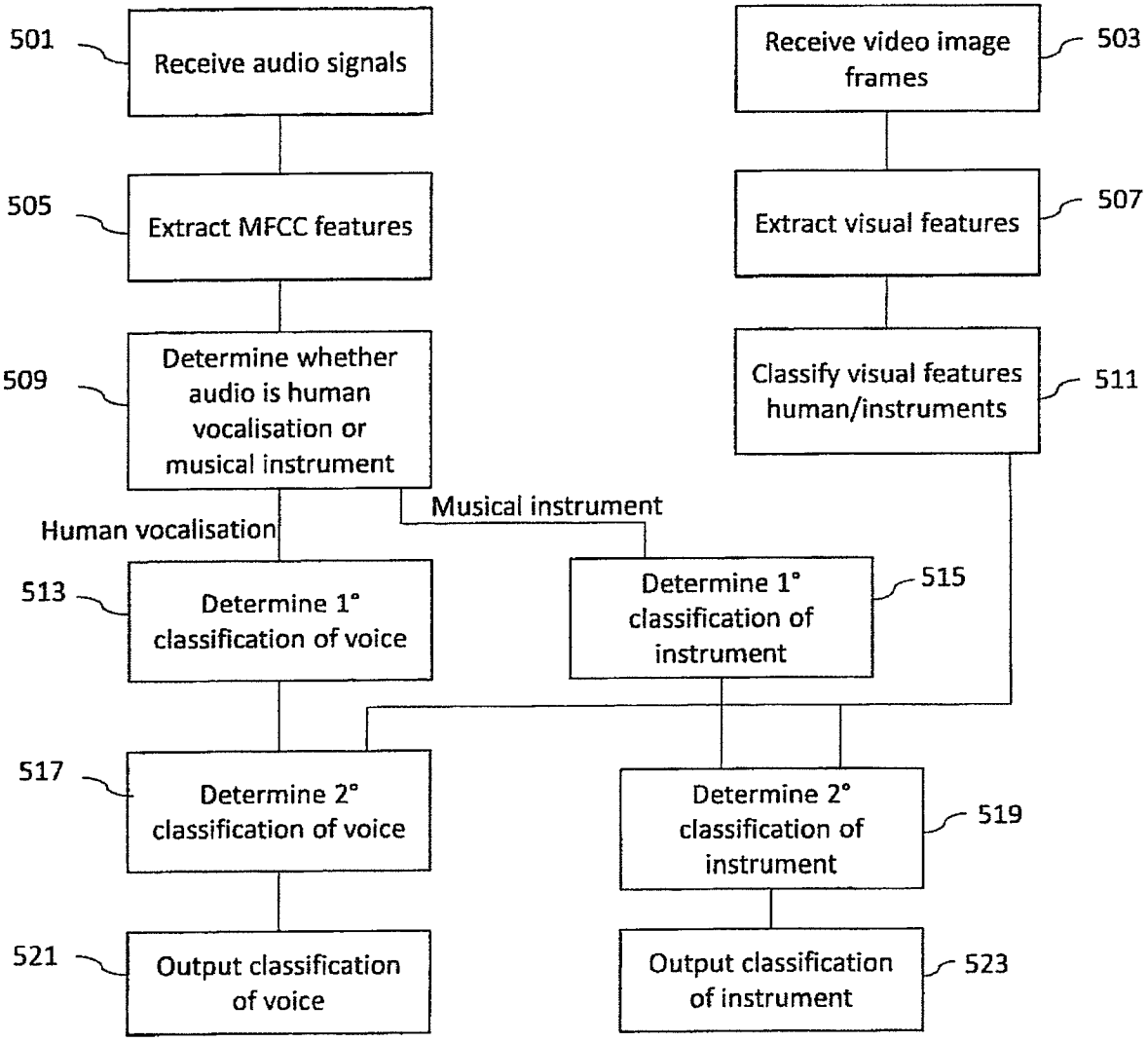
FIG. 5 shows a flow diagram of the operation of the example source analyser as shown in FIG. 2*a* according to some embodiments.

With respect to FIG. 5 a flow diagram showing the operation of the source analyser such as shown in FIG. 2*a* are shown.

The source analyser 201 may be configured to receive the audio signal(s).

The operation of receiving the audio signals is shown in FIG. 5 by step 501.

The source analyser 201 may furthermore be configured to extract suitable audio features such as mel-frequency cepstral coefficient (MFCC) features The operation of extracting audio features such as MFCC features is shown in FIG. 5 by step 505.

The source analyser 201 may furthermore be configured to determine whether the audio signal or the frame of the audio signal currently being analysed is either of the categories human vocalization or musical instrument.

The operation of determining whether the audio signals is either of the categories human vocalization or musical instrument is shown in FIG. 5 by step 509.

Where the analyser determines the audio signal (frame) is human vocalization then the analyser may further determine initial or primary voice classifications of the audio signal (frame), which may include determine parameters associated with the classification.

This determination of the primary voice classification is shown in FIG. 5 by step 513.

Where the analyser determines the audio signal (frame) is musical instrument then the analyser may further determine initial or primary instrument classifications of the audio signal (frame), which may include determine parameters associated with the classification.

This determination of the primary instrument classification is shown in FIG. 5 by step 515.

Furthermore the source analyser may receive the video or image frames, for example from the camera.

The operation of receiving the video or image frames is shown in FIG. 5 by step 503.

The source analyser may then extract suitable image or visual features from the images.

The operation of extracting suitable visual or image features is shown in FIG. 5 by step 507.

The source analyser may then be configured to use the extracted visual or image features to determine a visual based classification of the source and output this classification or parameters based on the classification based on the classification.

The operation of classifying the source based on the visual features is shown in FIG. 5 by step 511.

In some embodiments as described above the source analyser may then determine a final or secondary voice classification based on the primary voice classification and the visual classification information.

This determination of the secondary voice classification is shown in FIG. 5 by step 517.

The secondary voice classification and any associated source parameters may then be output to the renderer apparatus or stored.

The output of the classification of the voice for the source is shown in FIG. 5 by step 521.

In some embodiments as described above the source analyser may, for instrument sources, determine a final or secondary instrument classification based on the primary instrument classification and the visual classification information.

This determination of the secondary instrument classification is shown in FIG. 5 by step 519.

The secondary instrument classification and any associated source parameters may then be output to the renderer apparatus or stored.

The output of the classification of the instrument (for the source) is shown in FIG. 5 by step 523.

Figure 6:
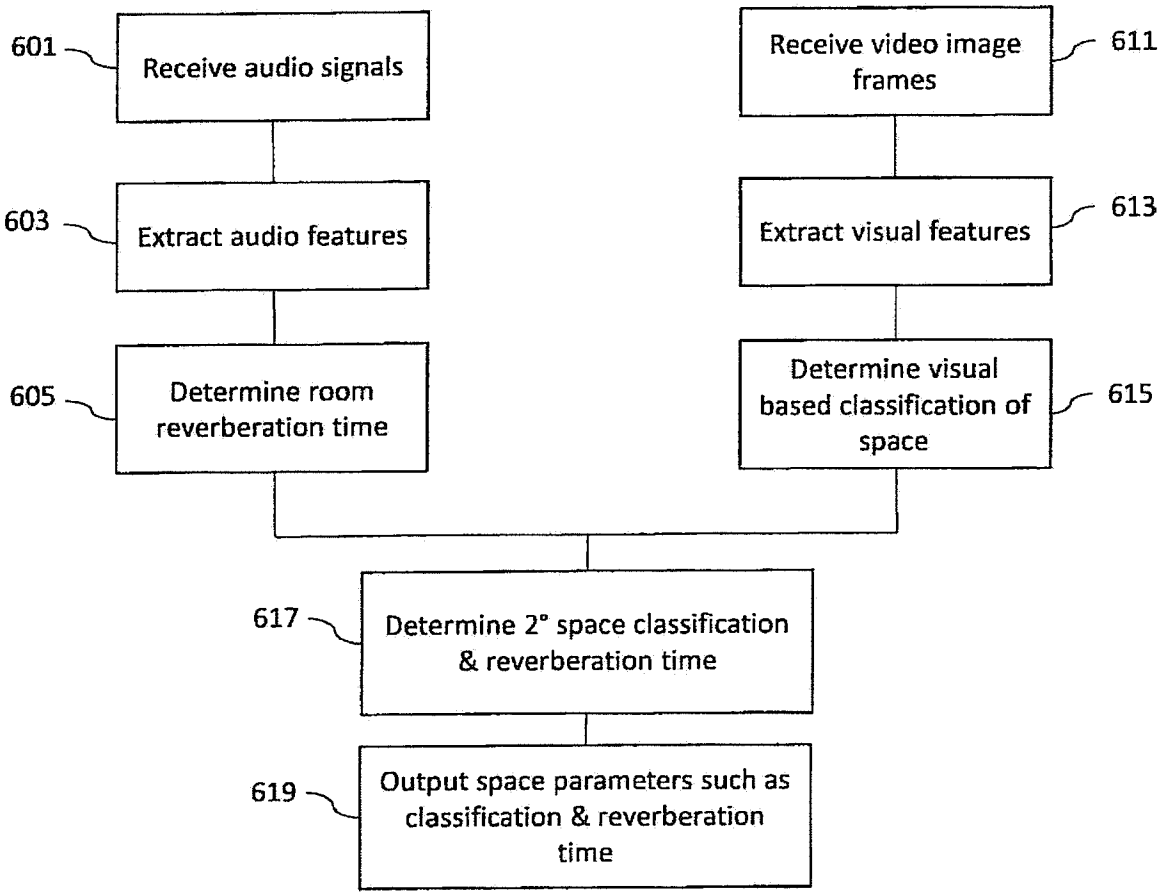
FIG. 6 shows a flow diagram of the operation of the example space analyser as shown in FIG. 2*b* according to some embodiments.

With respect to FIG. 6 an example of the operations of the space analyser 251 implemented within the analyser 109 is shown.

The space analyser 251 may be configured to receive the audio signals as discussed herein.

The operation of receiving audio signals is shown in FIG. 6 by step 601.

The space analyser 251 may then perform content analysis to classify the space and/or to determine a room reverberation parameter.

The operation of analysing the audio signal to extract suitable audio features is shown in FIG. 6 by step 603.

The space analyser 251 may then determine a reverberation time for the 'room' or space which may also be used to define or classify the space.

The determination of the room reverberation time is shown in FIG. 6 by step 605.

Furthermore the space analyser 251 may receive the video or image frames, such as from the camera.

The operation of receiving the video or image frames is shown in FIG. 6 by step 611.

The space analyser 251 may then perform content analysis to extract suitable visual features.

The operation of analysing the video or images to extract suitable visual features is shown in FIG. 6 by step 613.

The space analyser 251 may then determine or classify the space based on the extracted visual features.

The determination of the visual based classification of space is shown in FIG. 6 by step 615.

Furthermore the visual based classification and the audio based classification and reverberation time are further compared and analysed to determine a secondary or final space classification and reverberation time.

The determination of a secondary or final classification of the space (and other parameters associated with the classification such as the reverberation time) is shown in FIG. 6 by step 617.

The space analyser 251 may then output the final classification and any other space parameters to the render apparatus.

The outputting of the space parameters such as the final classification of the space is shown in FIG. 6 by step 619.

Figure 7:
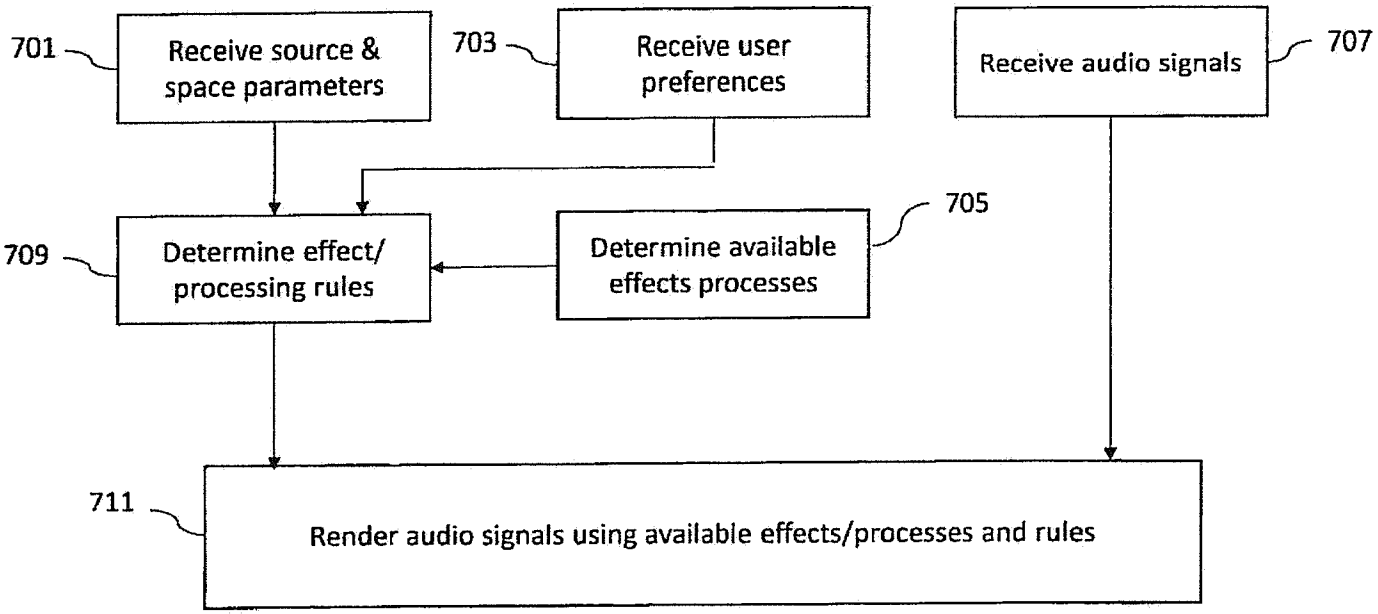
FIG. 7 shows a flow diagram of the operation of the example audio renderer as shown in FIG. 3 according to some embodiments.

With respect to FIG. 7 an example of the operations of the render apparatus 103 is shown.

The render apparatus 103 may receive the source and space parameters. For example the render apparatus 103 may receive the classification of the audio source, the classification of the space and furthermore the reverberation time of the 'room'.

The operation of receiving the source and space parameters is shown in FIG. 7 by step 701.

The render apparatus 103 may furthermore receive user preferences. For example the user preferences may be received from a user interface or may be stored in a memory (and include the initial or factory defined user preferences). The operation of receiving the user preferences is shown in FIG. 7 by step 703.

The render apparatus 103, may furthermore be configured to determine the effects or processing operations or routines which are available to be used. The operation of determining the available effects or routines for processing the audio signals is shown in FIG. 7 by step 705.

The render apparatus 103, may then determine or select the processing or effect ruleset for processing the audio signals based on the source and space parameters, the user preferences and the available effects. The operation of determining the effect/processing rules based on at least the source and space parameters is shown in FIG. 7 by step 709.

In some embodiments the render apparatus 103 receives the audio signals (for example from the capture apparatus 101). The operation of receiving the audio signals is shown in FIG. 7 by step 707.

The render apparatus 103 may then be configured to perform a suitable mixing/rendering of the audio signals which may be processed according to the determined rule set for processing and effects.

The operation of rendering the audio signals using the available effects/processing and rules is shown in FIG. 7 by step 711.

Figure 11:
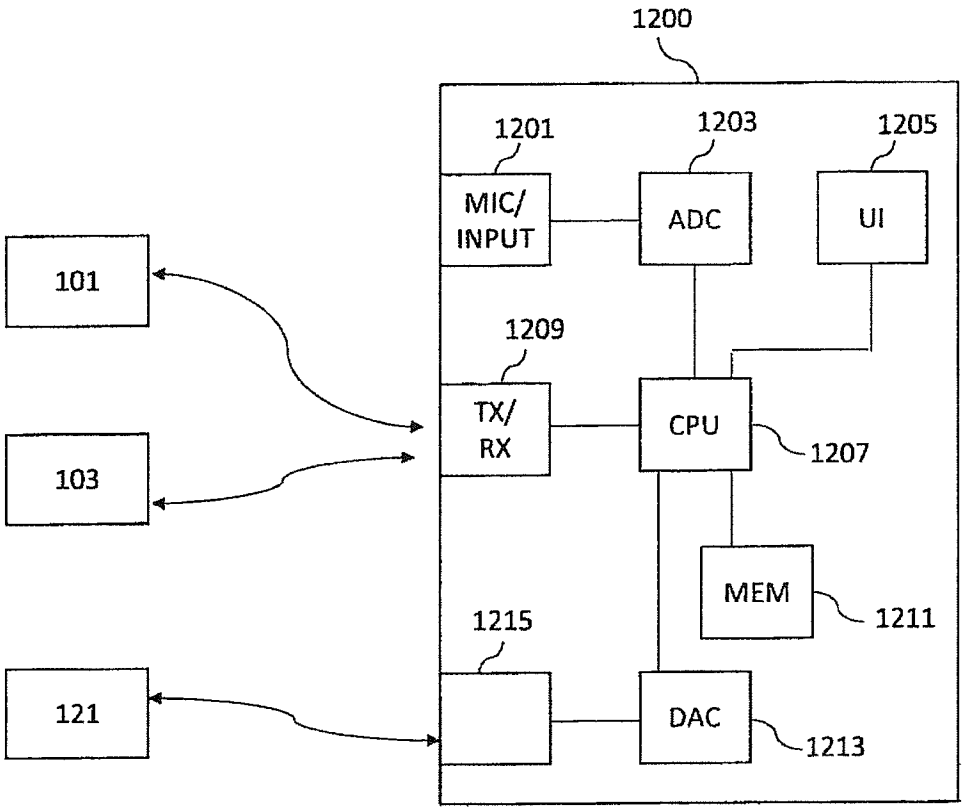
FIG. 11 shows schematically an example device suitable for implementing the capture and/or render apparatus shown in FIG. 1.

With respect to FIG. 11 an example electronic device which may be used as at least part of the capture apparatus 101 and/or render apparatus 103 is shown. For example the example electronic device may be employed as the SPAC device. The device may be any suitable electronics device or apparatus. For example in some embodiments the device 1200 is a mobile device, user equipment, tablet computer, computer, audio playback apparatus, etc.

The device 1200 may comprise a microphone array 1201. The microphone array 1201 may comprise a plurality (for example a number N) of microphones. However it is understood that there may be any suitable configuration of microphones and any suitable number of microphones. In some embodiments the microphone array 1201 is separate from the apparatus and the audio signals transmitted to the apparatus by a wired or wireless coupling. The microphone array 1201 may in some embodiments be the SPAC microphone array 113 as shown in FIG. 1.

The microphones may be transducers configured to convert acoustic waves into suitable electrical audio signals. In some embodiments the microphones can be solid state microphones. In other words the microphones may be capable of capturing audio signals and outputting a suitable digital format signal. In some other embodiments the microphones or microphone array 1201 can comprise any suitable microphone or audio capture means, for example a condenser microphone, capacitor microphone, electrostatic microphone, Electret condenser microphone, dynamic microphone, ribbon microphone, carbon microphone, piezoelectric microphone, or microelectrical-mechanical system (MEMS) microphone. The microphones can in some embodiments output the audio captured signal to an analogue-to-digital converter (ADC) 1203.

The SPAC device 1200 may further comprise an analogue-to-digital converter 1203. The analogue-to-digital converter 1203 may be configured to receive the audio signals from each of the microphones in the microphone array 1201 and convert them into a format suitable for processing. In some embodiments where the microphones are integrated microphones the analogue-to-digital converter is not required. The analogue-to-digital converter 1203 can be any suitable analogue-to-digital conversion or processing means. The analogue-to-digital converter 1203 may be configured to output the digital representations of the audio signals to a processor 1207 or to a memory 1211.

In some embodiments the device 1200 comprises at least one processor or central processing unit 1207. The processor 1207 can be configured to execute various program codes. The implemented program codes can comprise, for example, SPAC control, position determination and tracking and other code routines such as described herein.

In some embodiments the device 1200 comprises a memory 1211. In some embodiments the at least one processor 1207 is coupled to the memory 1211. The memory 1211 can be any suitable storage means. In some embodiments the memory 1211 comprises a program code section for storing program codes implementable upon the processor 1207. Furthermore in some embodiments the memory 1211 can further comprise a stored data section for storing data, for example data that has been processed or to be processed in accordance with the embodiments as described herein. The implemented program code stored within the program code section and the data stored within the stored data section can be retrieved by the processor 1207 whenever needed via the memory-processor coupling.

In some embodiments the device 1200 comprises a user interface 1205. The user interface 1205 can be coupled in some embodiments to the processor 1207. In some embodiments the processor 1207 can control the operation of the user interface 1205 and receive inputs from the user interface 1205. In some embodiments the user interface 1205 can enable a user to input commands to the device 1200, for example via a keypad. In some embodiments the user interface 205 can enable the user to obtain information from the device 1200. For example the user interface 1205 may comprise a display configured to display information from the device 1200 to the user. The user interface 1205 can in some embodiments comprise a touch screen or touch interface capable of both enabling information to be entered to the device 1200 and further displaying information to the user of the device 1200.

In some implements the device 1200 comprises a transceiver 1209. The transceiver 1209 in such embodiments can be coupled to the processor 1207 and configured to enable a communication with other apparatus or electronic devices, for example via a wireless communications network. The transceiver 1209 or any suitable transceiver or transmitter and/or receiver means can in some embodiments be configured to communicate with other electronic devices or apparatus via a wire or wired coupling.

For example as shown in FIG. 11 the transceiver 1209 may be configured to communicate with the render apparatus 103.

The transceiver 1209 can communicate with further apparatus by any suitable known communications protocol. For example in some embodiments the transceiver 209 or transceiver means can use a suitable universal mobile telecommunications system (UMTS) protocol, a wireless local area network (WLAN) protocol such as for example IEEE 802.X, a suitable short-range radio frequency communication protocol such as Bluetooth, or infrared data communication pathway (IRDA).

In some embodiments the device 1200 may be employed as a render apparatus. As such the transceiver 1209 may be configured to receive the audio signals and positional information from the capture apparatus 101, and generate a suitable audio signal rendering by using the processor 1207 executing suitable code. The device 1200 may comprise a digital-to-analogue converter 1213. The digital-to-analogue converter 1213 may be coupled to the processor 1207 and/or memory 1211 and be configured to convert digital representations of audio signals (such as from the processor 1207 following an audio rendering of the audio signals as described herein) to a suitable analogue format suitable for presentation via an audio subsystem output. The digital-to-analogue converter (DAC) 1213 or signal processing means can in some embodiments be any suitable DAC technology.

Furthermore the device 1200 can comprise in some embodiments an audio subsystem output 1215. An example, such as shown in FIG. 8, may be where the audio subsystem output 1215 is an output socket configured to enabling a coupling with the headphones 121. However the audio subsystem output 1215 may be any suitable audio output or a connection to an audio output. For example the audio subsystem output 1215 may be a connection to a multichannel speaker system.

In some embodiments the digital to analogue converter 1213 and audio subsystem 1215 may be implemented within a physically separate output device. For example the DAC 1213 and audio subsystem 1215 may be implemented as cordless earphones communicating with the device 1200 via the transceiver 1209.

Although the device 1200 is shown having both audio capture and audio rendering components, it would be understood that in some embodiments the device 1200 can comprise just the audio capture or audio render apparatus elements.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising:

at least one processor; and at least one memory including computer program code, the at least one memory and the computer program code configured, with the at least one processor, to cause the apparatus at least to:

receive a spatial audio signal associated with a microphone array providing spatial audio capture and at least one additional audio signal associated with an additional microphone, said microphone array being a spatial audio capture device providing spatial audio at a location of said microphone array and said additional microphone providing a close audio signal captured close to a vocal or instrumental audio source, the additional audio signal having been delayed with a variable delay determined such that common components of the spatial audio signal and the at least one additional audio signal are time-aligned;

receive position information identifying positions of the microphone array and of the additional microphone and identifying a relative position between a first position associated with the microphone array and a second position associated with the additional microphone;

receive at least one source parameter classifying an audio source associated with the common components and/or at least one space parameter identifying an environment within which the audio source is located;

determine at least one processing effect ruleset based on the at least one source parameter and/or the at least one space parameter, the at least one processing effect ruleset including preferences on effects to be applied to the at least one source parameter and the at least one space parameter;

mix and apply at least one processing effect to the spatial audio signal and the at least one additional audio signal based on the at least one processing effect ruleset to generate at least two output audio channel signals; and output said at least two output audio channel signals to an audio signal presentation device, wherein the apparatus is a rendering apparatus.

2. The apparatus as claimed in claim 1, wherein determine the at least one processing effect ruleset includes determining at least one processing effect to be applied to the at least one additional audio signal based on the at least one source parameter and/or the at least one space parameter.

3. The apparatus as claimed in claim 2, wherein at least one memory and the computer program code are further configured, with the at least one processor, to cause the apparatus to;

receive an effect user input; and determine the at least one processing effect to be applied to the at least one additional audio signal based on the effect user input.

4. The apparatus as claimed in claim 2, wherein the at least one memory and the computer program code are further configured, with the at least one processor, to cause the apparatus to:

determine a range of available inputs for parameters controlling the at least one processing effect based on the at least one source parameter and/or the at least one space parameter.

5. The apparatus as claimed in claim 4, wherein the at least one memory and the computer program code are further configured, with the at least one processor, to cause the apparatus to:

receive a parameter user input; and determine a parameter value from the range of available inputs for parameters controlling the at least one processing effect based on the parameter user input.

6. The apparatus as claimed in claim 1, wherein mix and apply the at least one processing effect to the spatial audio signal and the at least one additional audio signal to generate the at least two output audio channel signals includes mixing and appplying the at least one processing effect to the spatial audio signal and the at least one additional audio signal based on the relative position between the first position associated with the microphone array and the second position associated with the additional microphone.

7. An apparatus comprising:

at least one processor; and at least one memory including computer program code, the at least one memory and the computer program code configured, with the at least one processor, to cause the apparatus at least to:

determine a spatial audio signal captured with a microphone array at a first position providing spatial audio capture, said microphone array being a spatial audio capture device providing spatial audio at said first location;

determine at least one additional audio signal captured with an additional microphone at a second position, said additional microphone providing a close audio signal captured close to a vocal or instrumental audio source;

determine position information identifying said first position of the microphone array and said second position of the additional microphone and track a relative position between the first position and the second position;

determine a variable delay between the spatial audio signal and the at least one additional audio signal to time-align common components of the spatial audio signal and the at least one additional audio signal;

apply the variable delay to the at least one additional audio signal to align the common components of the spatial audio signal and at least one additional audio signal with one another;

determine at least one source parameter classifying an audio source associated with the common components and/or at least one space parameter identifying an environment within which the audio source is located based on the at least one additional audio signal; and output said spatial audio signal and said at least one additional audio signal time-aligned with one another, said relative position between said first position and said second position, said at least one source parameter, and said at least one space parameter to a rendering apparatus, wherein the apparatus is a capture apparatus.

8. The apparatus as claimed in claim 7, wherein determine the at least one space parameter includes at least one of:

determine a room reverberation time associated with the at least one additional audio signal;

determine a room classifier identifying a space type within which a spatial audio source is located;

determine at least one interim space parameter based on the at least one additional audio signal, determine at least one further interim space parameter based on an analysis of at least one camera image, and determine at least one final space parameter based on the at least one interim space parameter and the at least one further interim space parameter;

determine whether an at least one additional audio source is a vocal source or an instrument source based on an extracted feature analysis of the at least one additional audio signal, determine an interim vocal classification of the at least one additional audio source based on whether the at least one additional audio source is a vocal source or determine an interim instrument classification of the at least one additional audio source based on whether the at least one additional audio source is an instrument source; and receive at least one image from a camera capturing the at least one additional audio source, determine a visual classification of the at least one additional audio source based on the at least one image, and determine a final vocal classification of the at least one additional audio source based on the interim vocal classification and the visual classification or determine a final instrument classification based on the interim instrument classification and the visual classification.

9. A method comprising:

receiving a spatial audio signal associated with a microphone array providing spatial audio capture and at least one additional audio signal associated with an additional microphone, said microphone array being a spatial audio capture device providing spatial audio at a location of said microphone array and said additional microphone providing a close audio signal captured close to a vocal or instrumental audio source, the additional audio signal having been delayed with a variable delay determined such that common components of the spatial audio signal and the at least one additional audio signal are time-aligned;

receiving position information identifying positions of the microphone array and of the additional microphone and identifying a relative position between a first position associated with the microphone array and a second position associated with the additional microphone;

receiving at least one source parameter classifying an audio source associated with the common components and/or at least one space parameter identifying an environment within which the audio source is located;

determining at least one processing effect ruleset based on the at least one source parameter and/or the at least one space parameter, the at least one processing effect ruleset including preferences on effects to be applied to the at least one source parameter and the at least one space;

mixing and applying at least one processing effect to the spatial audio signal and the at least one additional audio signal based on the at least one processing effect ruleset to generate at least two output audio channel signals; and outputting said at least two output audio channel signals to an audio signal presentation device.

10. The method as claimed in claim 9, wherein determining the at least one processing effect ruleset comprises determining the at least one processing effect to be applied to the at least one additional audio signal based on the at least one source parameter and/or the at least one space parameter.

11. The method as claimed in claim 10, further comprising:

receiving an effect user input; and determining the at least one processing effect to be applied to the at least one additional audio signal is further based on the effect user input.

12. The method as claimed in claim 10, further cmprising:

determining a range of available inputs for parameters controlling the at least one processing effect based on the at least one source parameter and/or the at least one space parameter.

13. The method as claimed in claim 12, further comprising:

receiving a parameter user input; and determining a parameter value from the range of available inputs for parameters controlling the at least one processing effect based on the parameter user input.

14. The method as claimed in claim 9, wherein mixing and applying the at least one processing effect to the spatial audio signal and the at least one additional audio signal to generate the at least two output audio channel signals includes mixing and applying the at least one processing effect to the spatial audio signal and the at least one additional audio signal based on the relative position between the first position associated with the microphone array and the second position associated with the additional microphone.

15. A method comprising:

determining a spatial audio signal captured with a microphone array at a first position providing spatial audio capture, said microphone array being a spatial audio capture device providing spatial audio at said first location;

determining at least one additional audio signal captured with an additional microphone at a second position, said additional microphone providing a close audio signal captured close to a vocal or instrumental audio source;

determining position information identifying said first position of the microphone array and said second position of the additional microphone and tracking a relative position between the first position and the second position;

determining a variable delay between the spatial audio signal and the at least one additional audio signal to time-align common components of the spatial audio signal and the at least one additional audio signal;

applying the variable delay to the at least one additional audio signal to align the common components of the spatial audio signal and at least one additional audio signal with one another;

determining at least one source parameter classifying an audio source associated with the common components and/or at least one space parameter identifying an environment within which the audio source is located based on the at least one additional audio signal; and outputting said spatial audio signal and said at least one additional audio signal time-aligned with one another, said relative position between said first position and said second position, said at least one source parameter, and said at least one space parameter to a rendering apparatus.

16. The method as claimed in claim 15, wherein determining the at least one space parameter comprises at least one of:

determining a room reverberation time associated with the at least one additional audio signal;

determining a room classifier identifying a space type within which a spacial audio source is located;

determining at least one interim space parameter based on the at least one additional audio signal, determining at least one further interim space parameter based on an analysis of at least one camera image, and determining at least one final space parameter based on the at least one interim space parameter and the at least one further interim space parameter;

determining whether an at least one additional audio source is a vocal source or an instrument source based on an extracted feature analysis of the at least one additional audio signal, and determining an interim vocal classification of the at least one additional audio source based on whether the at least one additional audio source is a vocal source or determine an interim instrument classification of the at least one additional audio source based on whether the at least one additional audio source is an instrument source; and receiving at least one image from a camera capturing the at least one additional audio source, determining a visual classification of the at least one additional audio source based on the at least one image, and determining a final vocal classification of the at least one additional audio source based on the interim vocal classification and the visual classification or determine a final instrument classification based on the interim instrument classification and the visual classification.

17. The apparatus as claimed in claim 1, wherein said at least one source parameter includes human vocalization and type of musical instrument, and said at least one space parameter includes whether the environment is indoors or outdoors, and whether any reverberation is present.

18. The apparatus as claimed in claim 7, wherein said at least one source parameter includes human vocalization and type of musical instrument, and said at least one space parameter includes whether the environment is indoors or outdoors, and whether any reverberation is present.

19. The method as claimed in claim 9, wherein said at least one source parameter includes human vocalization and type of musical instrument, and said at least one space parameter includes whether the environment is indoors or outdoors, and whether any reverberation is present.

20. The method as claimed in claim 15, wherein said at least one source parameter includes human vocalization and type of musical instrument, and said at least one space parameter includes whether the environment is indoors or outdoors, and whether any reverberation is present.

* * * * *